US007824196B1

(12) United States Patent
Oddsen et al.

(10) Patent No.: US 7,824,196 B1
(45) Date of Patent: Nov. 2, 2010

(54) MULTIPLE OUTLET ELECTRICAL RECEPTACLE

(75) Inventors: Dennis A. Oddsen, Northport, NY (US); Jian H. Li, New York, NY (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 12/458,646

(22) Filed: Jul. 17, 2009

(51) Int. Cl.
*H01R 4/66* (2006.01)

(52) U.S. Cl. ..... 439/106

(58) Field of Classification Search ..... 439/536, 439/538, 654, 106; 174/54
See application file for complete search history.

(56) References Cited

U.S. PATENT DOCUMENTS

| | | | | |
|---|---|---|---|---|
| 1,752,225 | A | 3/1930 | Birchall | |
| 1,831,809 | A | 11/1931 | Hertzberg | |
| 3,017,601 | A | 1/1962 | Benander | |
| 3,327,277 | A | 6/1967 | Ramsing | |
| 4,240,686 | A | 12/1980 | Kurbikoff | |
| 4,545,631 | A | 10/1985 | Zampini | |
| 4,583,799 | A | 4/1986 | Wiley | |
| D284,758 | S | 7/1986 | Maloney | |
| 4,688,135 | A | 8/1987 | Leopold | |
| 4,978,318 | A * | 12/1990 | Wiley et al. | 439/536 |
| 5,124,876 | A | 6/1992 | Misencik et al. | |
| 5,281,154 | A | 1/1994 | Comerci et al. | |
| 5,763,826 | A | 6/1998 | Castellani et al. | |
| D402,186 | S | 12/1998 | Pearse | |
| 6,196,851 | B1 | 3/2001 | Gerard et al. | |
| 6,353,180 | B1 | 3/2002 | DeBartolo et al. | |
| 6,483,028 | B2 | 11/2002 | DeBartolo et al. | |
| D467,875 | S | 12/2002 | Barger et al. | |
| D505,856 | S | 6/2005 | Kim et al. | |
| 6,902,429 | B1 * | 6/2005 | Brooks | 439/535 |
| 6,923,663 | B2 | 8/2005 | Oddsen et al. | |
| 7,071,414 | B2 * | 7/2006 | Kim | 174/66 |
| 7,121,834 | B2 | 10/2006 | Gerard | |
| 7,125,256 | B2 | 10/2006 | Gerard | |

(Continued)

FOREIGN PATENT DOCUMENTS

| | | |
|---|---|---|
| JP | 3055776 | 3/1991 |

(Continued)

*Primary Examiner*—Jean F Duverne
(74) *Attorney, Agent, or Firm*—Alan I. Cantor; Mark S. Bicks; Alfred N. Goodman

(57) ABSTRACT

An electrical receptacle with a body sized to fit in a NEMA-standard single wall box has a substantially rectangular face with phase blade openings, neutral blade openings and ground prong openings associated with respective first, second and third outlets, each outlet having a centerline passing through its ground prong opening parallel to its phase and neutral blade openings. The centerline of the first outlet is oblique to the edges of the face and oblique to the centerline of at least one other outlet. The centerlines of all of the outlets may be mutually nonparallel, and they may be mutually oblique. The centerline of the second outlet may be parallel to an edge of the face; and if so, the centerline of the third outlet may be either perpendicular to or parallel to the centerline of the second outlet. In a preferred arrangement, the centerlines are mutually nonparallel, and the ground prong openings of two of the outlets are located at corners of the face that share a common longer edge. All of the arrangements simultaneously accommodate plugs, chargers and transformers of many known sizes and types.

52 Claims, 21 Drawing Sheets

U.S. PATENT DOCUMENTS

| | | | | |
|---|---|---|---|---|
| D532,375 | S | 11/2006 | Kim et al. | |
| 7,193,830 | B2 | 3/2007 | Fournier et al. | |
| 7,238,028 | B2 | 7/2007 | Gerard | |
| 7,278,878 | B2 | 10/2007 | Draggie et al. | |
| 7,347,724 | B2 | 3/2008 | Crupi | |
| 7,547,221 | B2 * | 6/2009 | Kim et al. | 439/211 |
| 2003/0024724 | A1 * | 2/2003 | Leifer | 174/53 |
| 2005/0211460 | A1 | 9/2005 | Draggie et al. | |
| 2005/0239336 | A1 * | 10/2005 | Crupi | 439/654 |
| 2005/0263313 | A1 | 12/2005 | Oddsen et al. | |
| 2007/0149061 | A1 | 6/2007 | Oddsen et al. | |

FOREIGN PATENT DOCUMENTS

| | | |
|---|---|---|
| JP | 6245346 | 9/1994 |

* cited by examiner

MULTIPLE OUTLET ELECTRICAL RECEPTACLE

FIELD OF THE INVENTION

The invention relates to electrical receptacles, in particular, to multiple outlet electrical receptacles that are mountable in standard electrical wall boxes.

BACKGROUND OF THE INVENTION

Contemporary electrical receptacles designed to fit in a NEMA-standard single electrical wall box typically have two polarized grounded outlets, with the face openings of the outlets oriented in the same direction. Such an arrangement provides ample clearance for two straight plugs and for some, but not all, types of right angle plugs, chargers and transformers. Some duplex receptacles are designed to accommodate two larger transformers or chargers and most right angle plugs by orienting the face openings of the outlets in different directions. See, e.g., U.S. Pat. No. 7,278,878 to Draggie, et al.

The need to power three or more devices from a duplex receptacle usually requires the use of unwieldy cube taps or power strips. Efforts have been made to fit three or more grounded outlets, oriented in different directions, into a receptacle body that can fit into a NEMA-standard single wall box. See, e.g., U.S. Pat. No. 6,923,663 to Oddsen, et al., and U.S. Pat. No. 7,347,724 to Crupi. However, such solutions require non-standard constructions. For example, the ANSI/NEMA WD 6 (R2008) dimensional standard for popular "decorator" style wiring devices ("Dimensions for Flush Mount Rectangular Face Devices") specifies maximum face dimensions for a duplex receptacle of 1.300 in. wide by 2.620 in. long, and a mating wall plate opening at least 0.010 in. larger in each dimension. The receptacles of Oddsen, and those of Crupi having more than two outlets, do not comply with this standard because they have oversize rectangular faces and require oversize matching wall plates. Crupi's marginal ground prong openings (and the ground prongs received therein) undesirably are disposed outside the perimeter of the wall box. Oddsen's triplex receptacle (FIG. 1), with all ground prong openings centrally clustered, is prone to blockage of open slots when certain chargers, transformers or right angle plugs are used. The same problems are inherent in Oddsen's "sixplex" receptacle (FIG. 16), which is sized to fit into a standard double or ganged wall box.

A need therefore exists for a standard-size electrical receptacle for mounting in a standard single wall box, especially a decorator-style receptacle, having three outlets that can accommodate plugs, chargers and transformers of many sizes and types at once, with all ground prongs kept within the wall box. Similarly, a need exists for a standard-size electrical receptacle for mounting in a standard-size double wall box, especially a decorator-style receptacle, having six outlets that can also accommodate plugs, chargers and transformers of many sizes and types at once, with all ground prongs kept within the wall box.

SUMMARY OF THE INVENTION

In a basic arrangement, an electrical receptacle according to the invention comprises a body sized to fit in a NEMA-standard single wall box and having a substantially rectangular face defined by two shorter edges and two longer edges; and phase, neutral and ground contacts within the body associated with respective first, second and third outlets and accessible by the phase blades, neutral blades and ground prongs of plugs or electrical devices via respective phase blade openings, neutral blade openings and ground prong openings in the face. Each outlet has a centerline that passes through its ground prong opening and is parallel to its phase and neutral blade openings; and the centerline of the first outlet is oblique to the edges of the face and oblique to the centerline of at least one other outlet.

Various relative angular orientations of the outlets come under the umbrella of this basic arrangement. For example, the centerlines of all of the outlets may be mutually nonparallel, and they may be mutually oblique. The centerline of the second outlet may be parallel to an edge of the face; and if so, the centerline of the third outlet may be either perpendicular to or parallel to the centerline of the second outlet.

Various individual outlet orientations also come under the umbrella of this basic arrangement. Preferably, the ground prong opening of the first outlet is further from the center of the face than its phase and neutral blade openings; preferably is at a corner of the face; and preferably is laterally open, aligned with a laterally open groove in the body. The same preferably applies to the ground prong opening of the second outlet, whose centerline preferably also is oblique to the edges of the face. Further, the corner locations of the ground prong openings of the first and second outlets preferably are on the same side of the receptacle, at the opposite ends of a common longer edge of the face. Still further, the centerline of the third outlet preferably is parallel to and medially of the shorter edges of the face; and its ground prong opening preferably is located closer to the common longer edge of the face than its phase and neutral blade openings.

The various triplex outlet arrangements described above may also be embodied on each side of an electrical receptacle comprising a body sized to fit in a NEMA-standard double wall box, thus providing a receptacle having six outlets. The body has a side-by-side pair of spaced substantially rectangular faces, each face defined by two shorter edges and two longer edges, and each side having interior contacts and face openings as variously described above. The arrangements of openings on each face preferably mirror each other.

In any of the single-box or double-box arrangements described above, one of the outlets of any face—preferably the center outlet—may be replaced by another electrical device, such as a timer; a dimmer; a power monitoring device; a circuit breaker; a power indicator light; a signal port; an integral night light; an over-current protection device; a ground fault circuit interrupter (GFCI); or a transient voltage surge suppressor (TVSS).

BRIEF DESCRIPTION OF THE DRAWINGS

Preferred embodiments of the disclosed invention, including the best mode for carrying out the invention, are described in detail below, purely by way of example, with reference to the accompanying drawing, in which.

DETAILED DESCRIPTION OF THE INVENTION

As used in this application, terms such as "front," "rear," "side," "top," "bottom," "above," "below," "upwardly" and "downwardly" are intended to facilitate the description of the electrical receptacle of the invention, and are not intended to limit the structure of the invention to any particular position or orientation.

Figure 1:
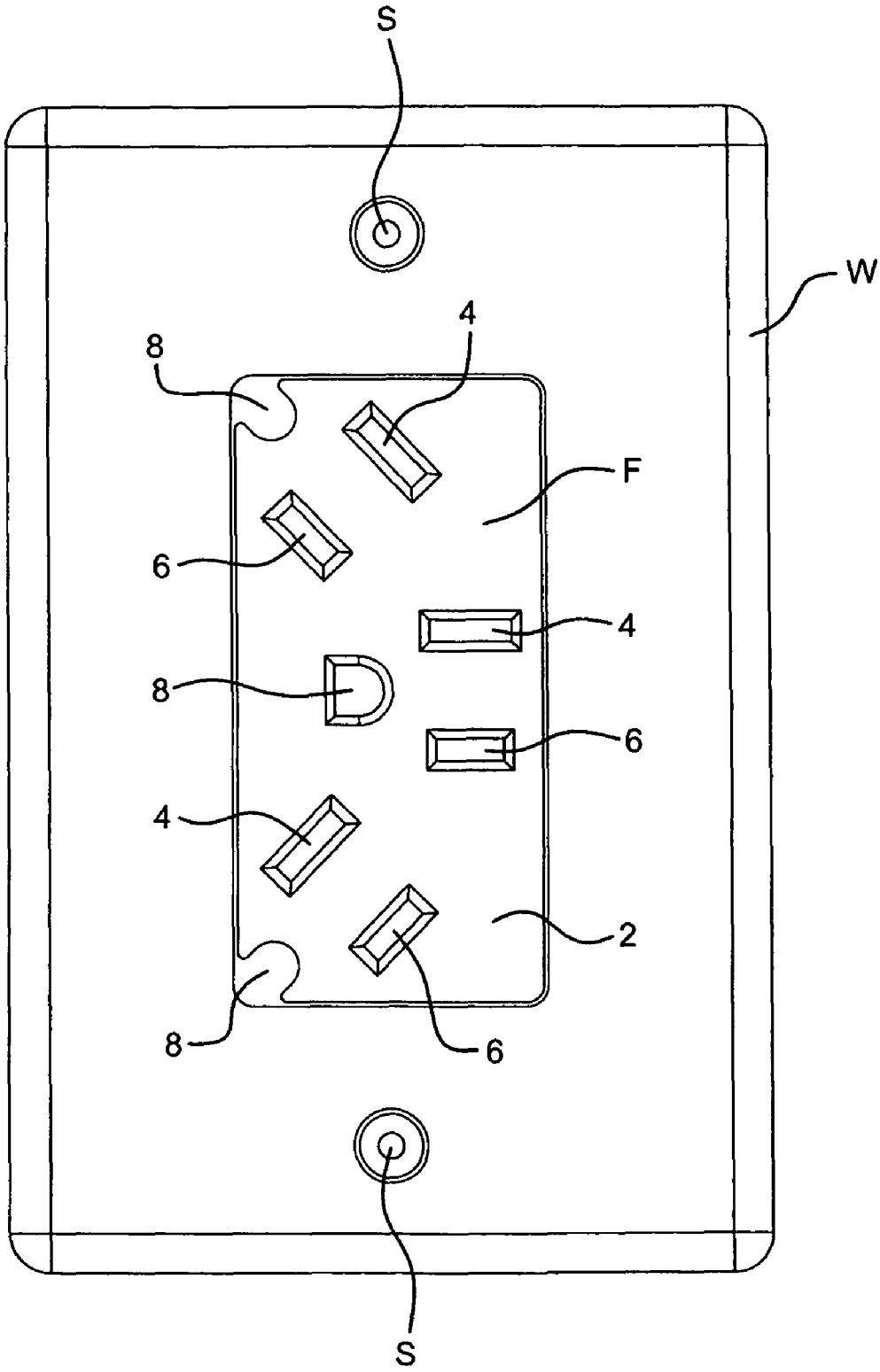
FIG. 1 is a front view of a preferred embodiment of electrical receptacle according to the invention, installed behind a wall plate.
Figure 24:
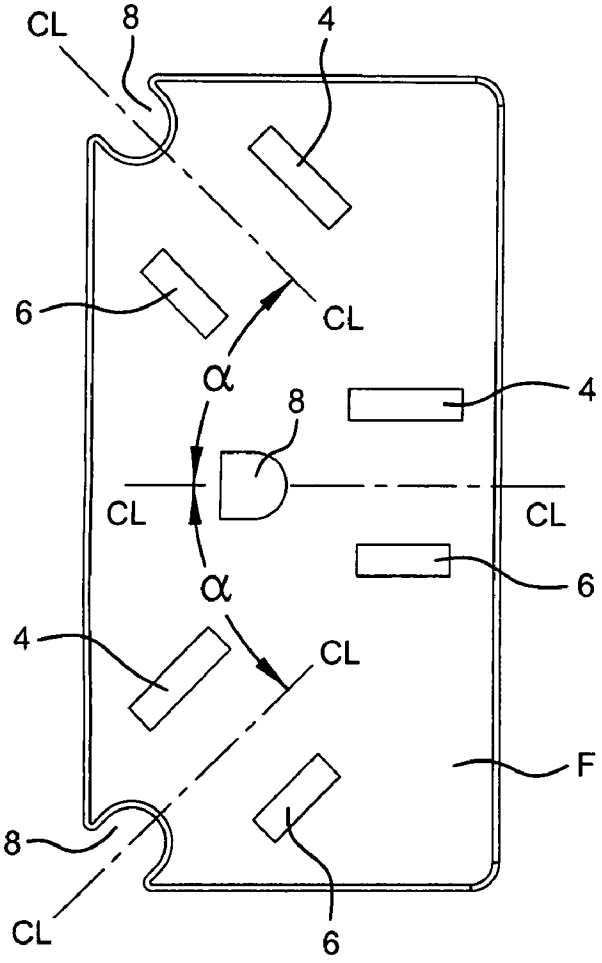
FIG. 24 is a schematic front view of the outlet face opening arrangement of the preferred embodiment of FIG. 1.

Referring to FIGS. 1 and 24, an electrical receptacle according to a preferred embodiment of the invention has a body sized to fit in a NEMA-standard single wall box. The body has a front cover 2 with rectangular face F, which is exposed through a slightly larger rectangular opening in a wall plate W having mounting screw holes S. The dimensions of face F comply with the ANSI/NEMA WD 6 (R2008) dimensional standard for popular "decorator" style wiring devices ("Dimensions for Flush Mount Rectangular Face Devices"), which specifies maximum face dimensions for a duplex receptacle of 1.300 in. wide by 2.620 in. long, and a mating wall plate opening at least 0.010 in. larger in each dimension. In this and all other embodiments specifically disclosed herein, the duplex-sized face of the receptacle preferably is 1.290 in. wide by 2.604 in. long. The face F has three outlets associated with respective phase, neutral and ground contacts (not shown), which are accessible through respective phase blade openings 4, neutral blade openings 6 and ground prong openings 8 in the face.

The size and spacing of the openings for each outlet also comply with ANSI/NEMA WD 6 (R2008); thus, the phase blade openings 4 are illustrated as longer that the neutral blade openings 6. Phase blade openings 4 are illustrated as simple straight slots, which is the standard configuration for 15 ampere receptacles. If the receptacle is intended for use in a 20 ampere circuit with 15 ampere and/or 20 ampere plugs, one or more of the outlets would have a NEMA-standard T-shaped phase blade opening.

Each outlet has a centerline CL (see FIG. 24) that passes through its ground prong opening 8 and is parallel to its phase and neutral blade openings 4, 6. The two outer outlets are positioned with their laterally open ground prong openings 8 at the corners of the face F, and with their centerlines oblique to the edges of the face, preferably at an angle of about 45°. The centerline of the central outlet is parallel to the shorter edges of the face, and bisects the face. Thus, the centerlines of the outlets are mutually nonparallel; and those of the corner outlets are disposed at an angle $\alpha$ of about 45° to the centerline of the center outlet.

Figure 2:
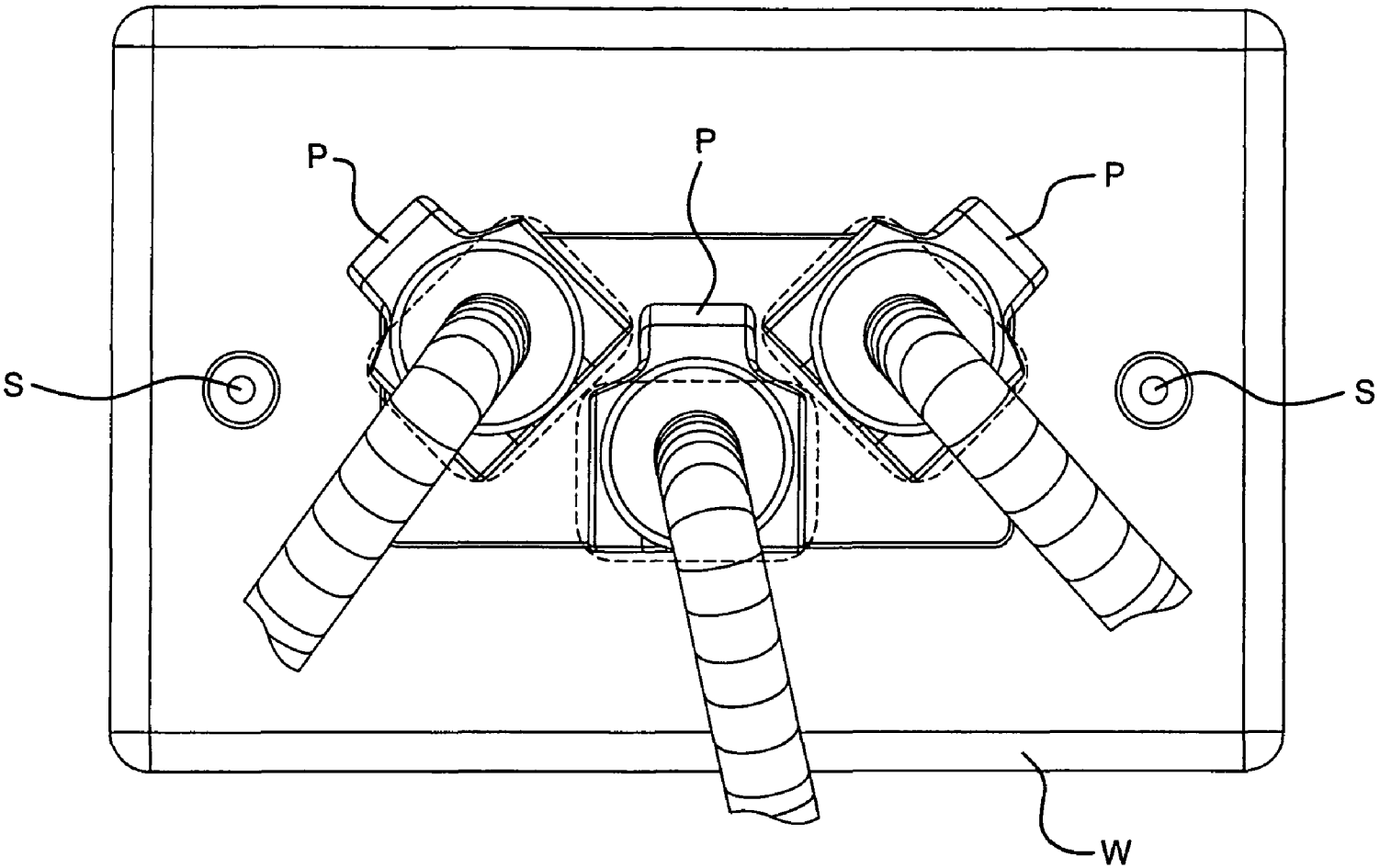
FIG. 2 is a front view similar to FIG. 1, showing a three-wire grounded plug installed in each outlet.
Figure 3:
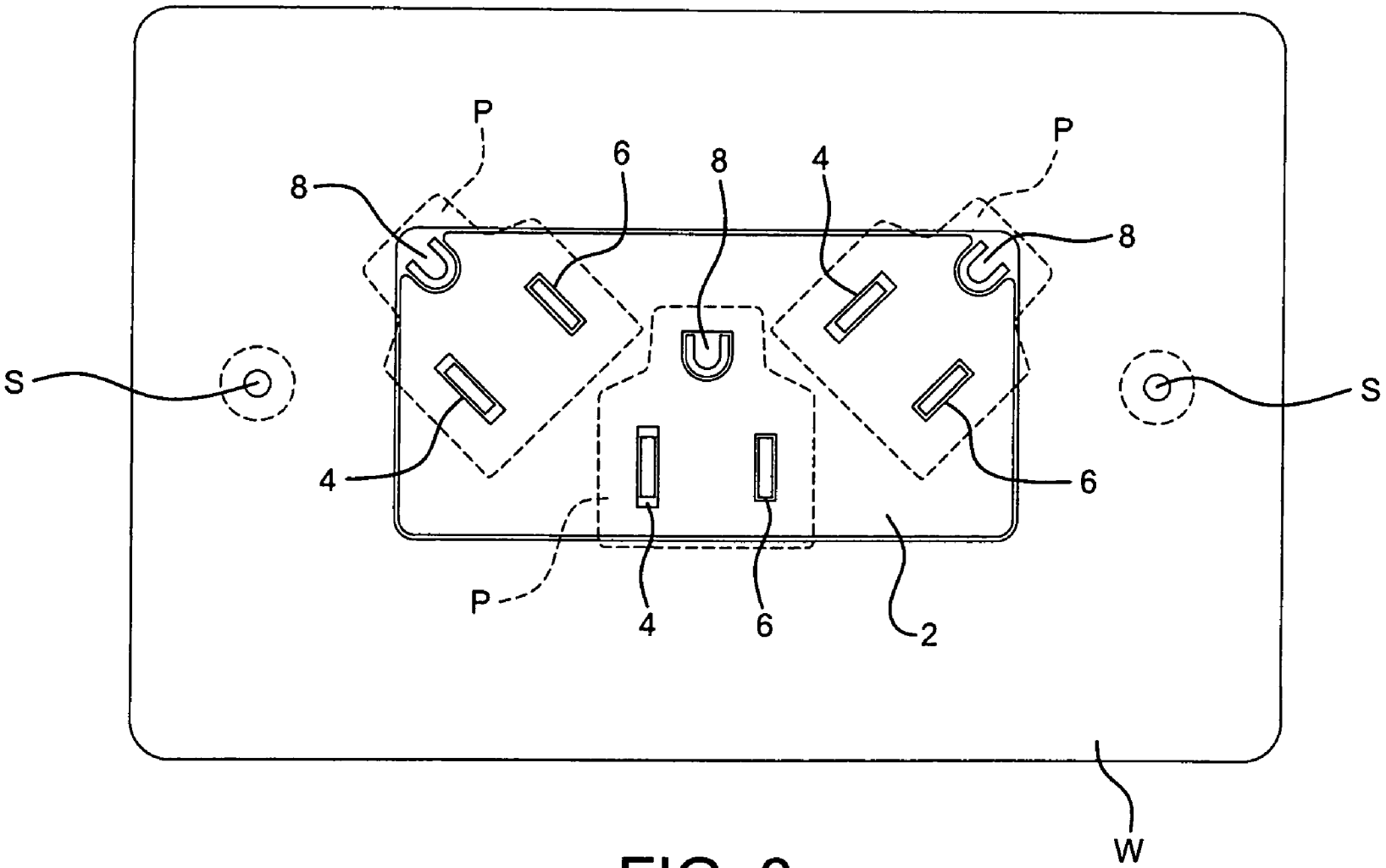
FIG. 3 is a rear schematic view of the arrangement shown in FIG. 2.
Figure 4:
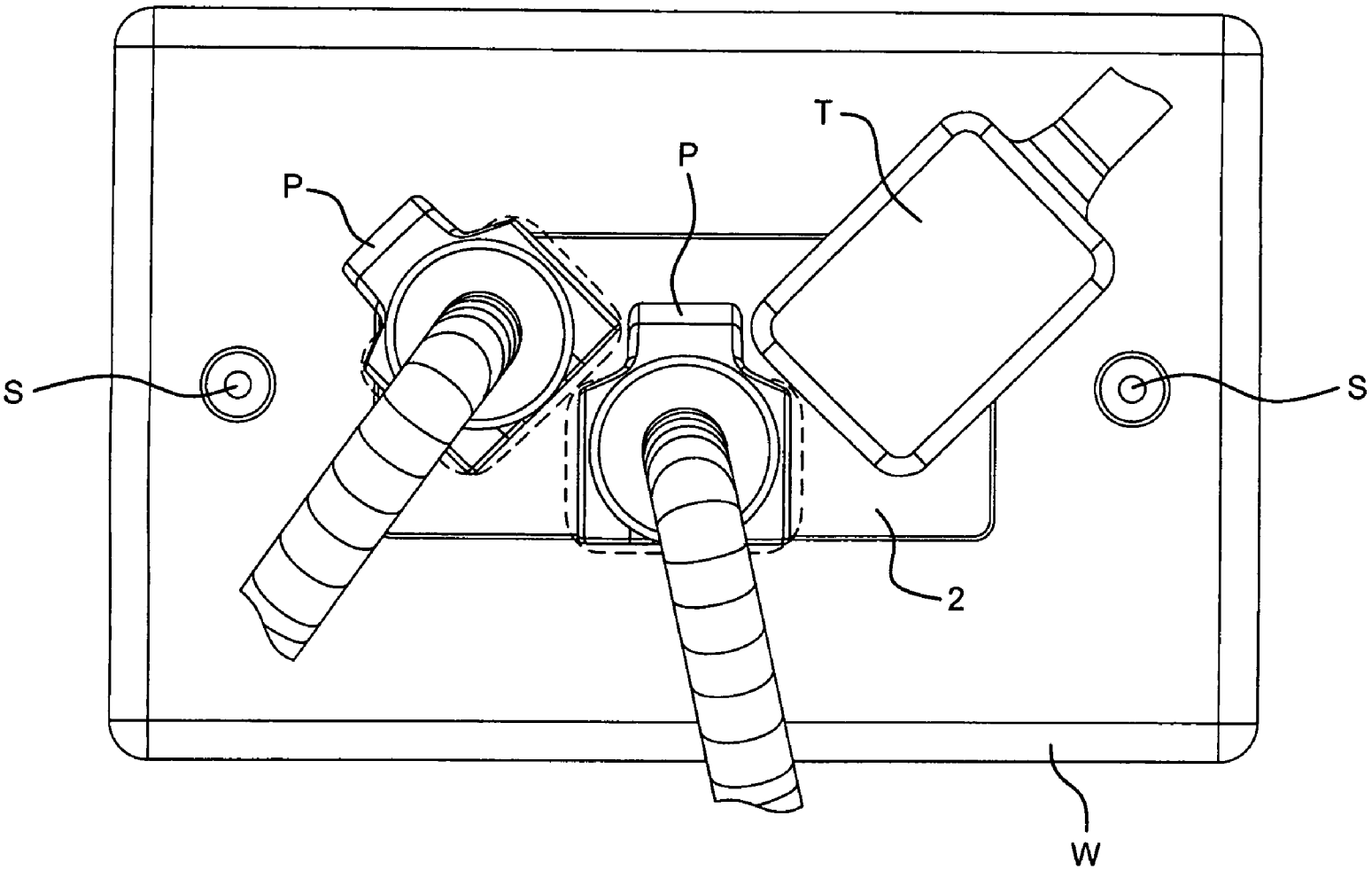
FIG. 4 is a front view similar to FIG. 2, showing two three-wire grounded plugs and one transformer installed in respective outlets.
Figure 5:
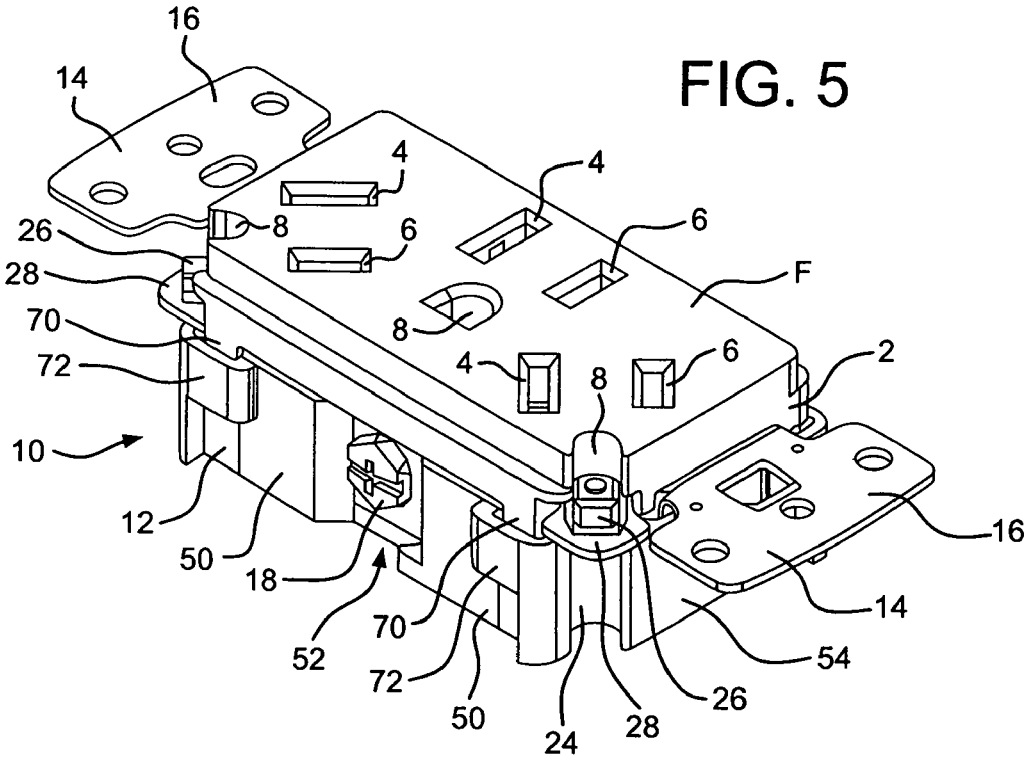
FIG. 5 is a perspective view of the receptacle of FIG. 1 without the wall plate, showing the face, one side and one end thereof.
Figure 6:
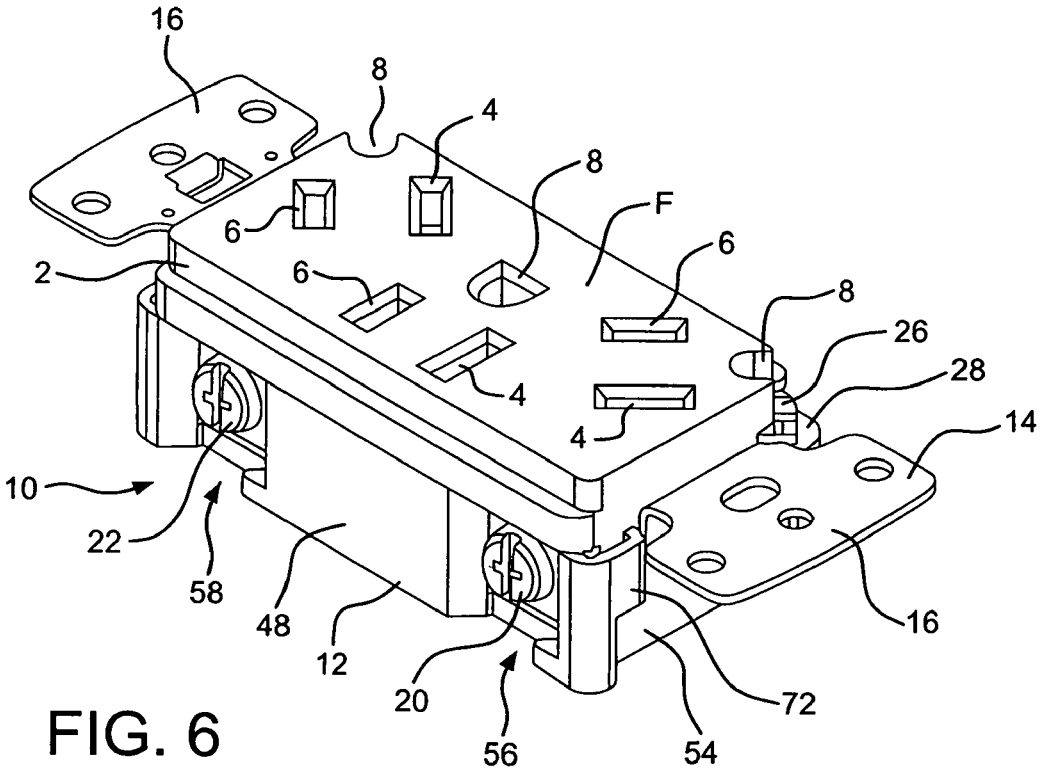
FIG. 6 is a perspective view of the receptacle of FIG. 5, showing the face, the opposite side and the opposite end thereof.
Figure 7:
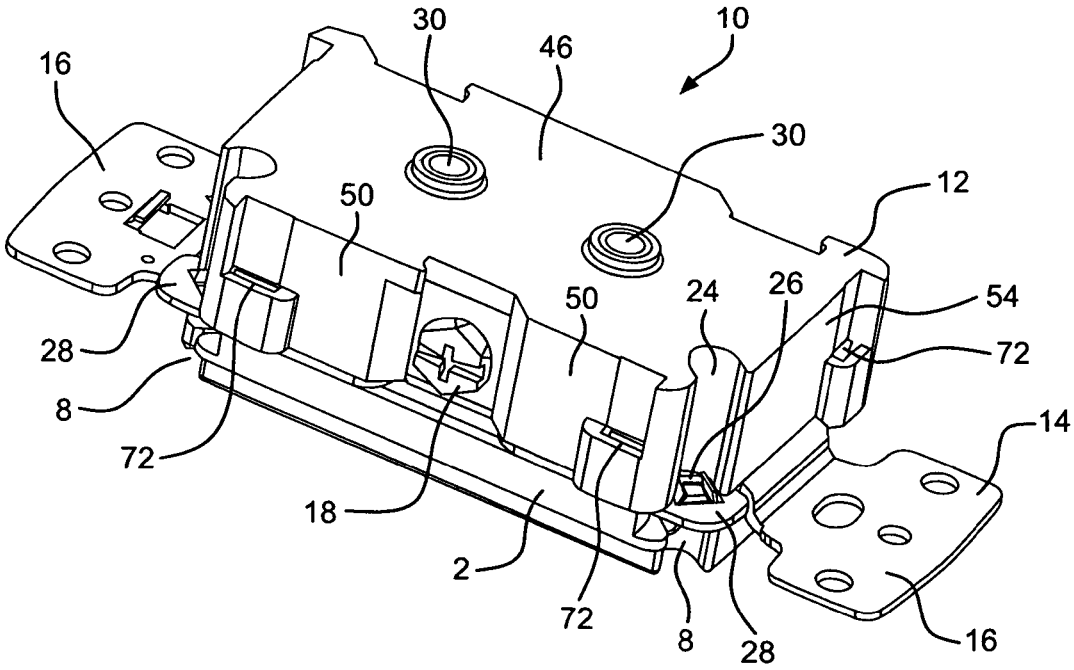
FIG. 7 is a bottom perspective view of the receptacle of FIG. 5.
Figure 8:
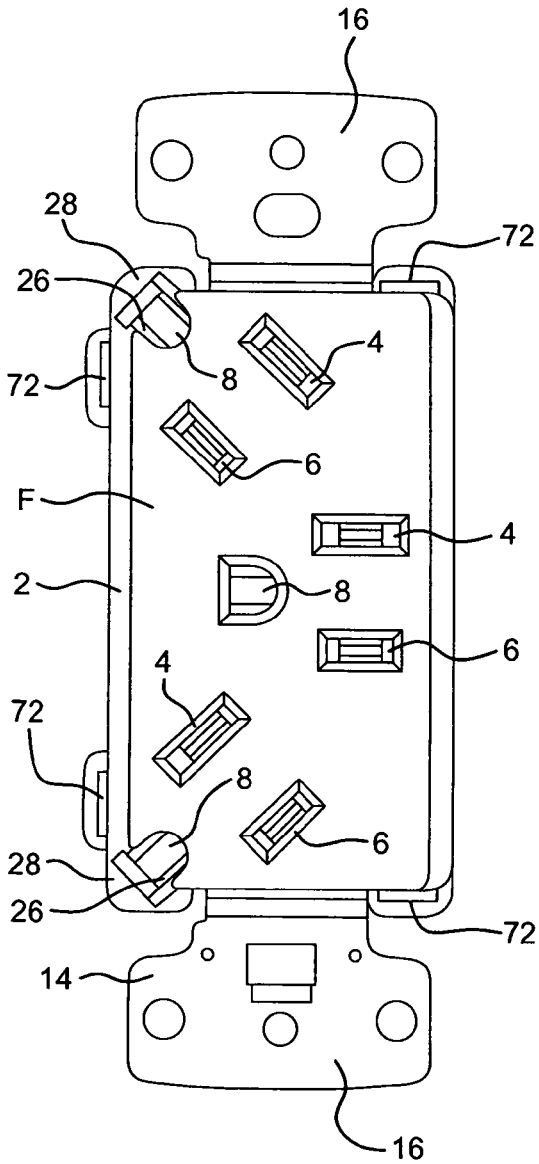
FIG. 8 is a front elevational view of the receptacle of FIG. 5.
Figure 9:
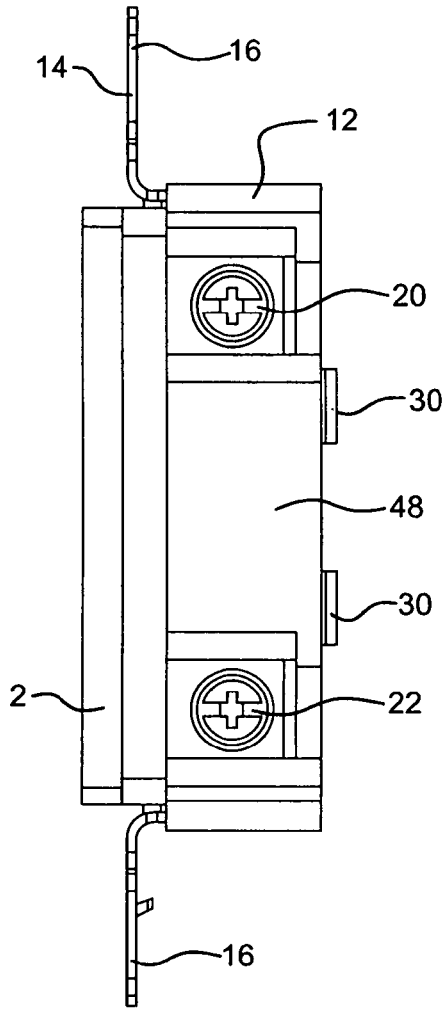
FIG. 9 is a right-side view of the receptacle of FIG. 5.
Figure 10:
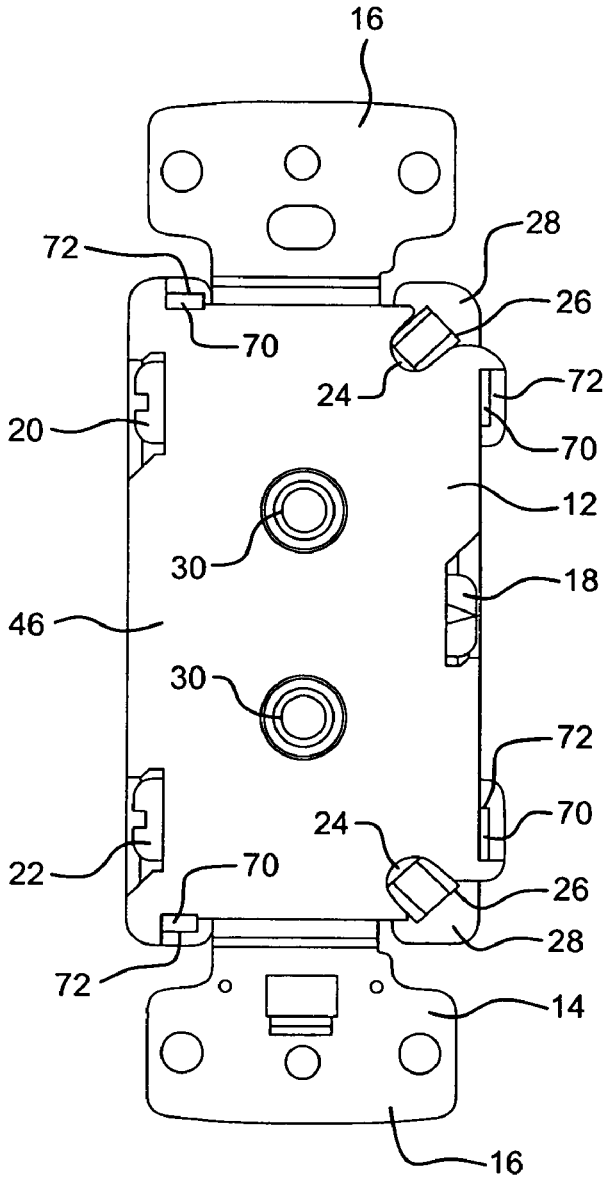
FIG. 10 is a rear elevational view of the receptacle of FIG. 5.
Figure 11:
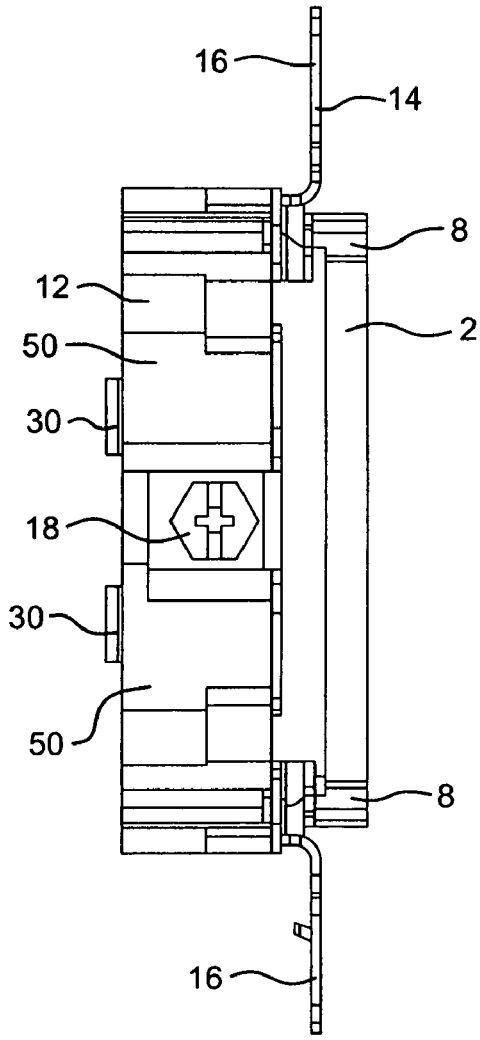
FIG. 11 is a left-side view of the receptacle of FIG. 5.
Figure 12:
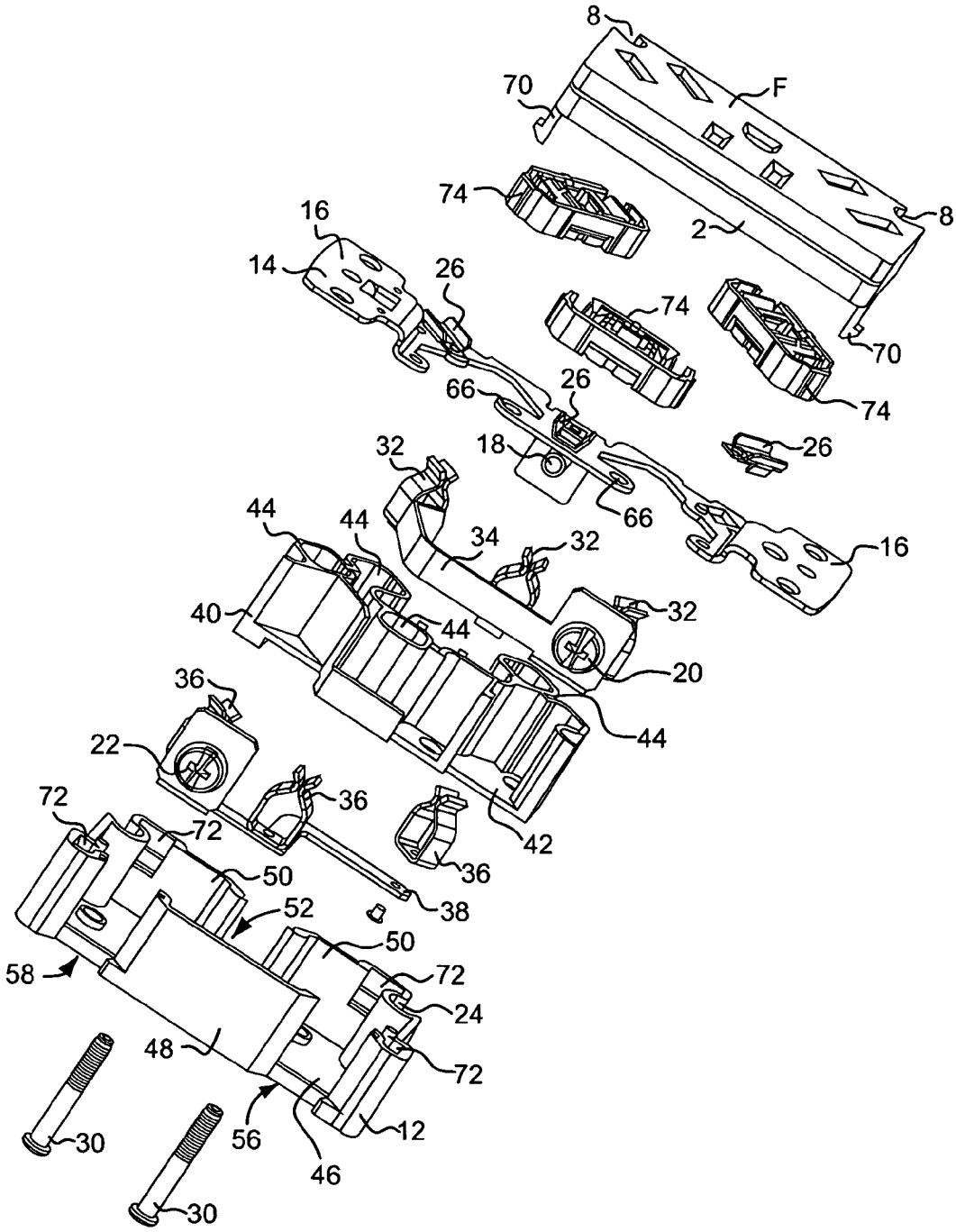
FIG. 12 is an exploded view of the receptacle of FIG. 5.
Figure 13:
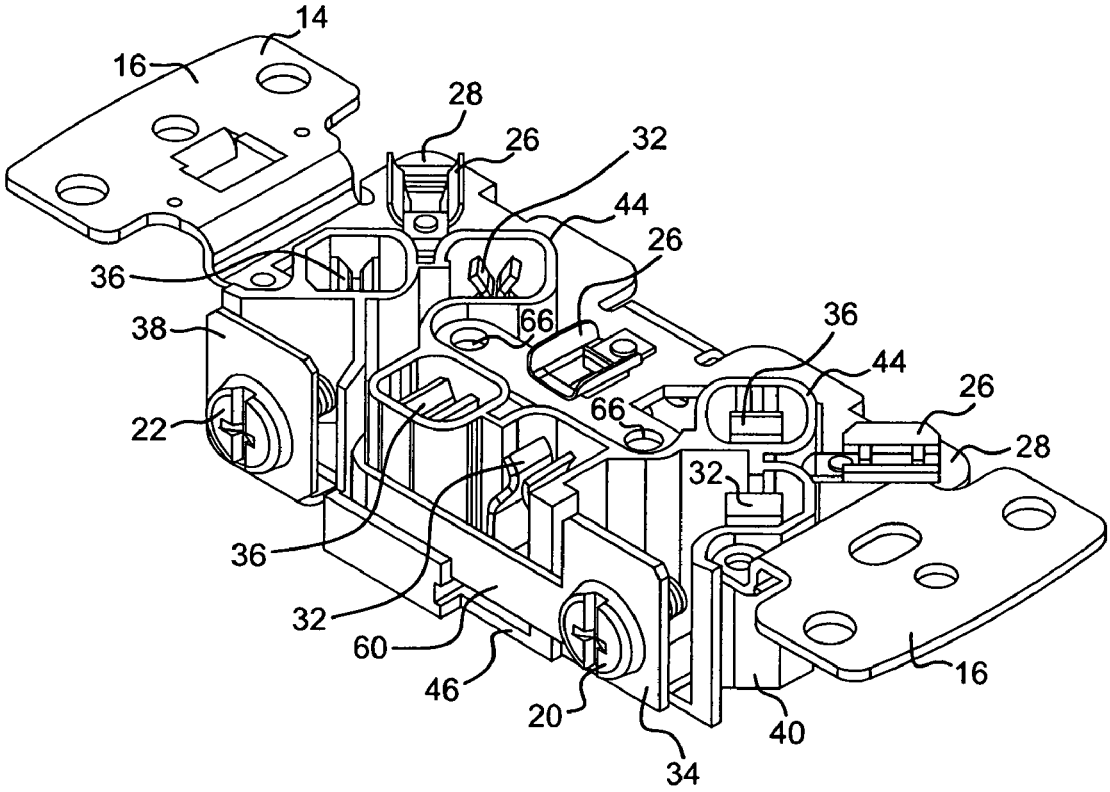
FIG. 13 is a perspective view of the receptacle of FIG. 5 with the base and the front cover removed to show the ground strap, the bus bars, the contacts and the contact separator.
Figure 14:
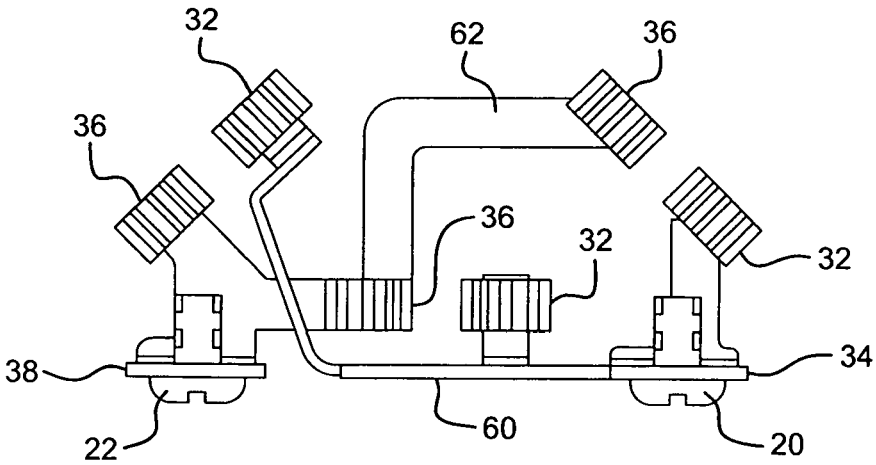
FIG. 14 is a top plan view of the phase and neutral bus bars and contacts per se shown in their proper spatial arrangement.
Figure 15:
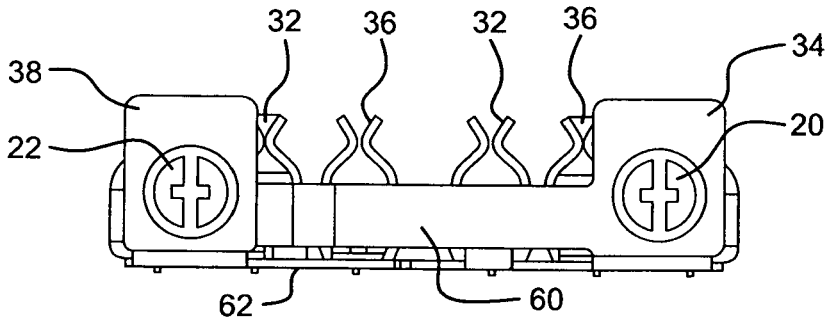
FIG. 15 is a front elevational view of the phase and neutral bus bar and contact arrangement of FIG. 14.
Figure 16:
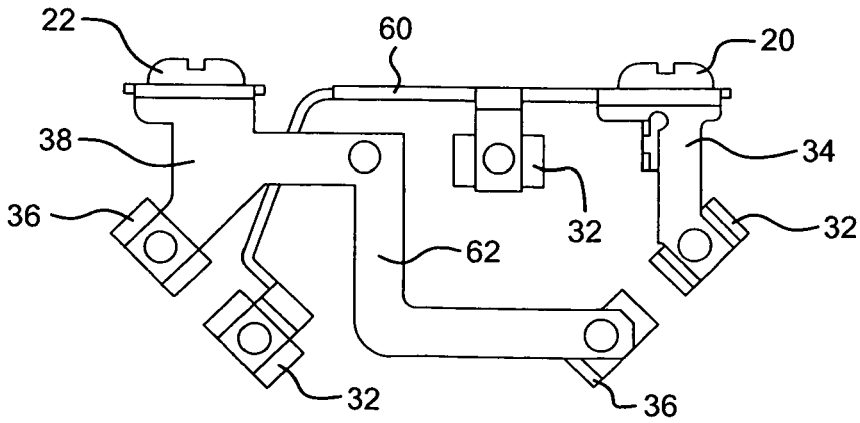
FIG. 16 is a bottom plan view of the phase and neutral bus bar and contact arrangement of FIG. 14.
Figure 17:
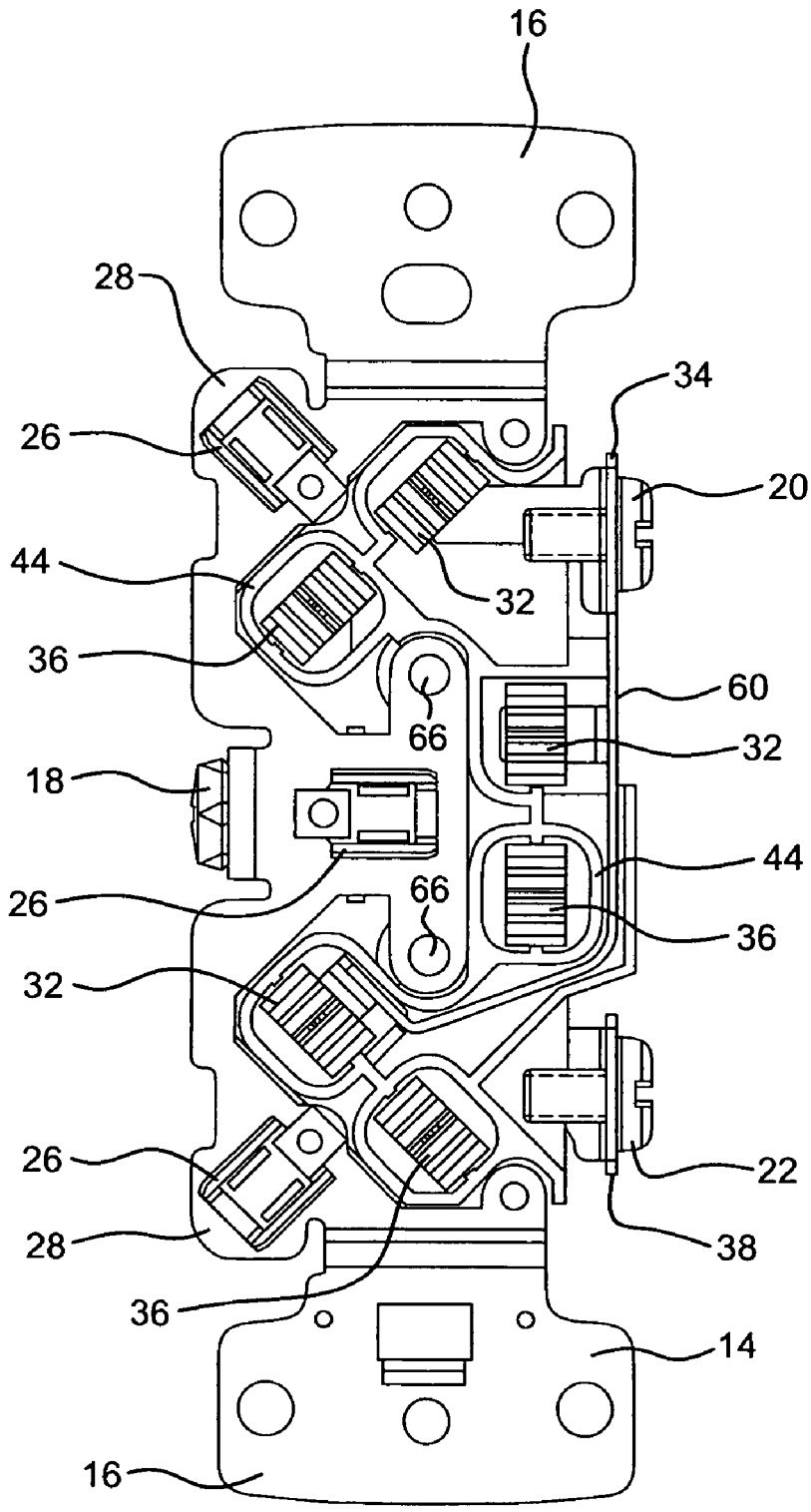
FIG. 17 is a top plan view of the ground strap, bus bar, contact and separator arrangement shown in FIG. 13.
Figure 18:
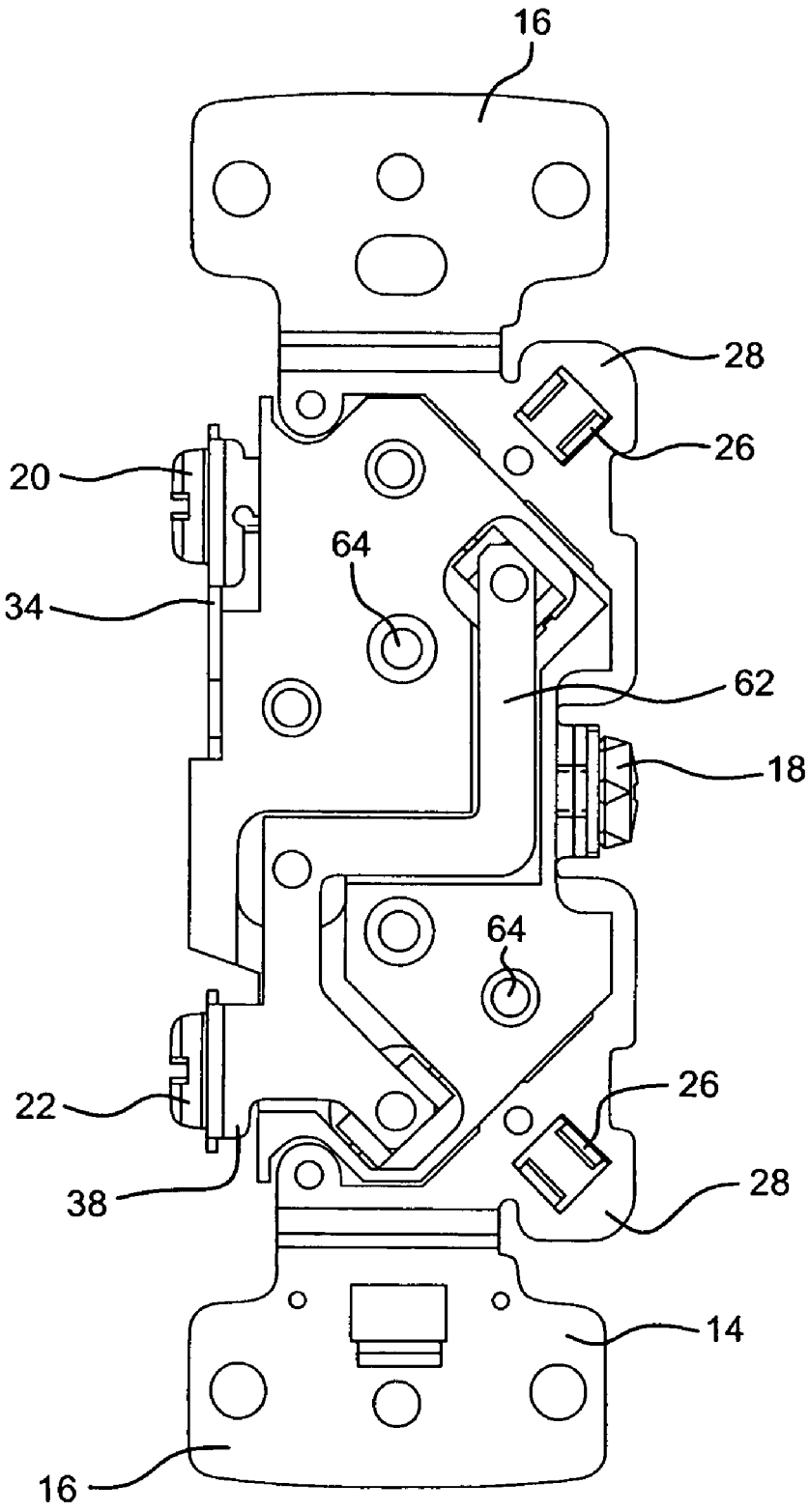
FIG. 18 is a bottom plan view of the ground strap, bus bar, contact and separator arrangement shown in FIG. 13.

FIGS. 2 and 3 illustrate how the receptacle of FIG. 1 can simultaneously accommodate three plugs, all of the grounded (three-wire) type P, or all of the two-wire type, or any combination of those types. The dashed lines in FIG. 2 show the nominal outline of the face of a two-wire general-use plug as specified by ANSI/UL 817-2007, §25.2.1 (1.000 in. by 0.750 in., maximum corner radius of 7/32 in.). FIG. 3 shows the blades and the ground prongs of the plugs received in the face openings 4, 6, 8. FIG. 4 illustrates how the receptacle of FIG. 1 can simultaneously accommodate at least one transformer T in combination with three-wire plugs P and/or two-wire plugs (dashed lines). It will be appreciated that two such transformers, one in each corner outlet (not shown), can be accommodated along with a plug in the center outlet.

FIGS. 5-11 depict the external features of the receptacle of FIGS. 1 and 24. Receptacle body 10 has an insulating plastic base 12 and an insulating plastic front cover 2 attached to a conducting metallic ground strap 14 sandwiched between the base and the front cover. Flanges 16 of ground strap 14 have standard mounting holes for attaching the receptacle to a wall box with screws, and standard threaded holes for attaching a wall plate W with screws through screw holes S. Screw terminals, which provide connections to line conductors, consist of a ground terminal 18 on the left side of the base 12, and a phase terminal 20 and a neutral terminal 22 on the right side. The face F of front cover 2 has openings 4, 6, 8 as described above. The laterally open ground prong openings 8 at the corners of the face are aligned with corner grooves 24 in the base 12 so as to accommodate the ground prongs of plugs that penetrate corner openings 8 and ground contacts 26, which are carried by two protruding corners 28 of ground strap 14.

Assembly screws 30, along with other fastening elements (described below), secure base 12, ground strap 14 and front cover 2 together.

Referring to FIGS. 12-18, three phase contacts 32 are riveted or otherwise secured to a phase bus bar 34, and three neutral contacts 36 are riveted or otherwise secured to a neutral bus bar 38. Bus bars 34, 38 are flat brass stampings. An insulating plastic contact separator 40 fits within base 12 and has a bottom wall 42 and upstanding dividers 44 that insulate the phase and neutral bus bars and contacts from one another. Base 12 has a bottom wall 46; a central upstanding side wall 48 at the phase terminal and neutral terminal side of the receptacle; two upstanding side walls 50 at the opposite side of the receptacle defining a gap 52 therebetween (in which ground terminal 18 resides); and upstanding end walls 54 joined to walls 50 and defining therewith corner grooves 24. Side wall 48 and end walls 54 define two gaps 56, 58. Phase bus bar 34 is disposed above the bottom wall 42 of contact separator 40. The upstanding side portion 60 of phase bus bar 34 runs behind side wall 48, with phase terminal 20 exposed in gap 56. Neutral terminal 22 is exposed in gap 58. The flat S-shaped portion 62 of neutral bus bar 38 lies between the bottom wall 42 of contact separator 40 and the bottom wall 46 of base 12.

Assembly screws 30 pass through holes (not shown) in bottom wall 46 of base 12, holes 64 in bottom wall 42 of contact separator 40, and holes 66 in ground strap 14. Screws 30 engage bosses 68 on the underside of front cover 2 (see FIG. 19) to secure the parts together. Four snap fasteners also hold the parts together. These consist of four shouldered tabs 70 on front cover 2 that fit into and lock against mating structures (not shown) within slots 72 on base 12.

Figure 19:
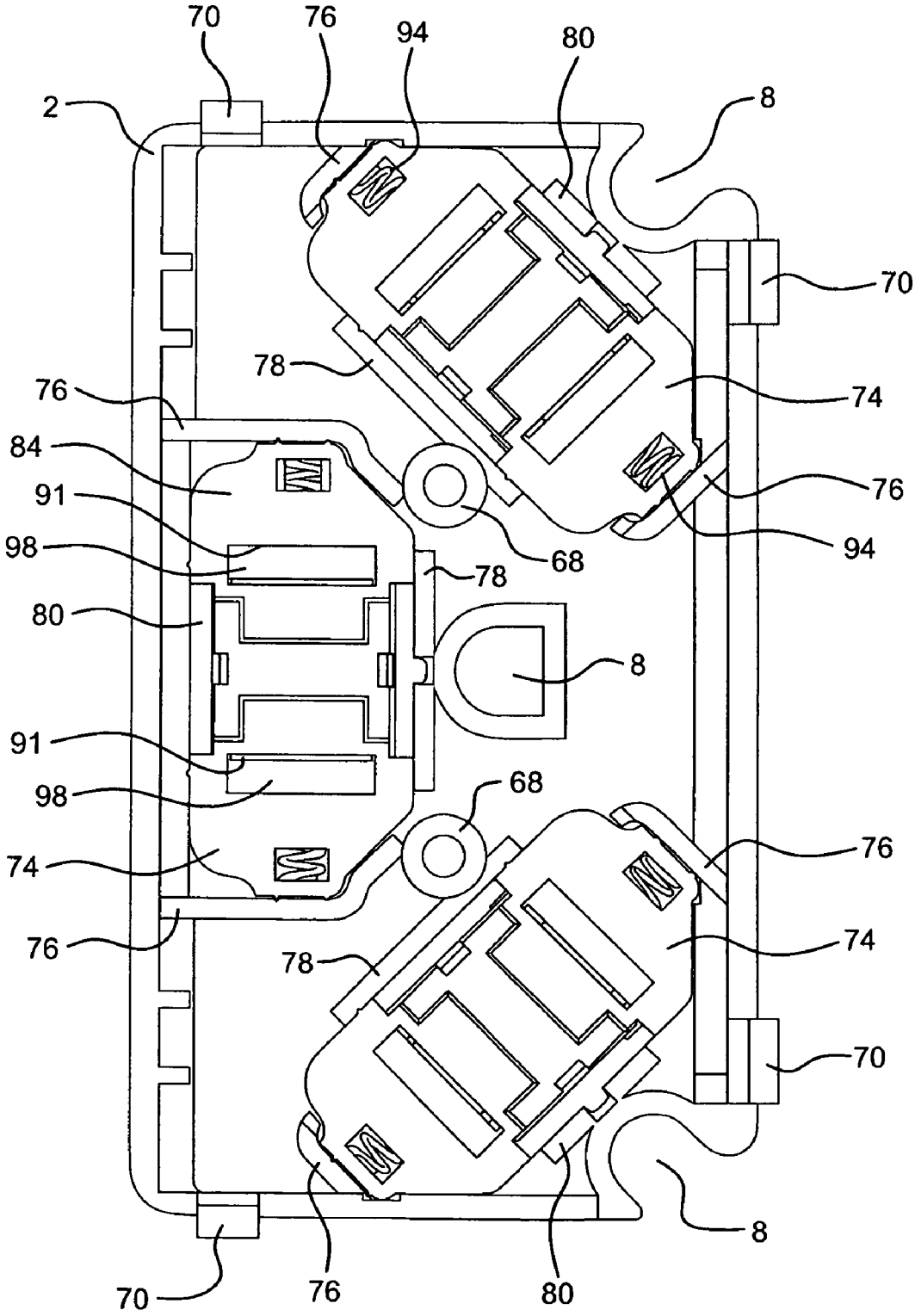
FIG. 19 is a bottom plan view of the front cover of the receptacle of FIG. 5, showing three tamper-resistant mechanisms installed therein, one for each outlet.
Figure 20:
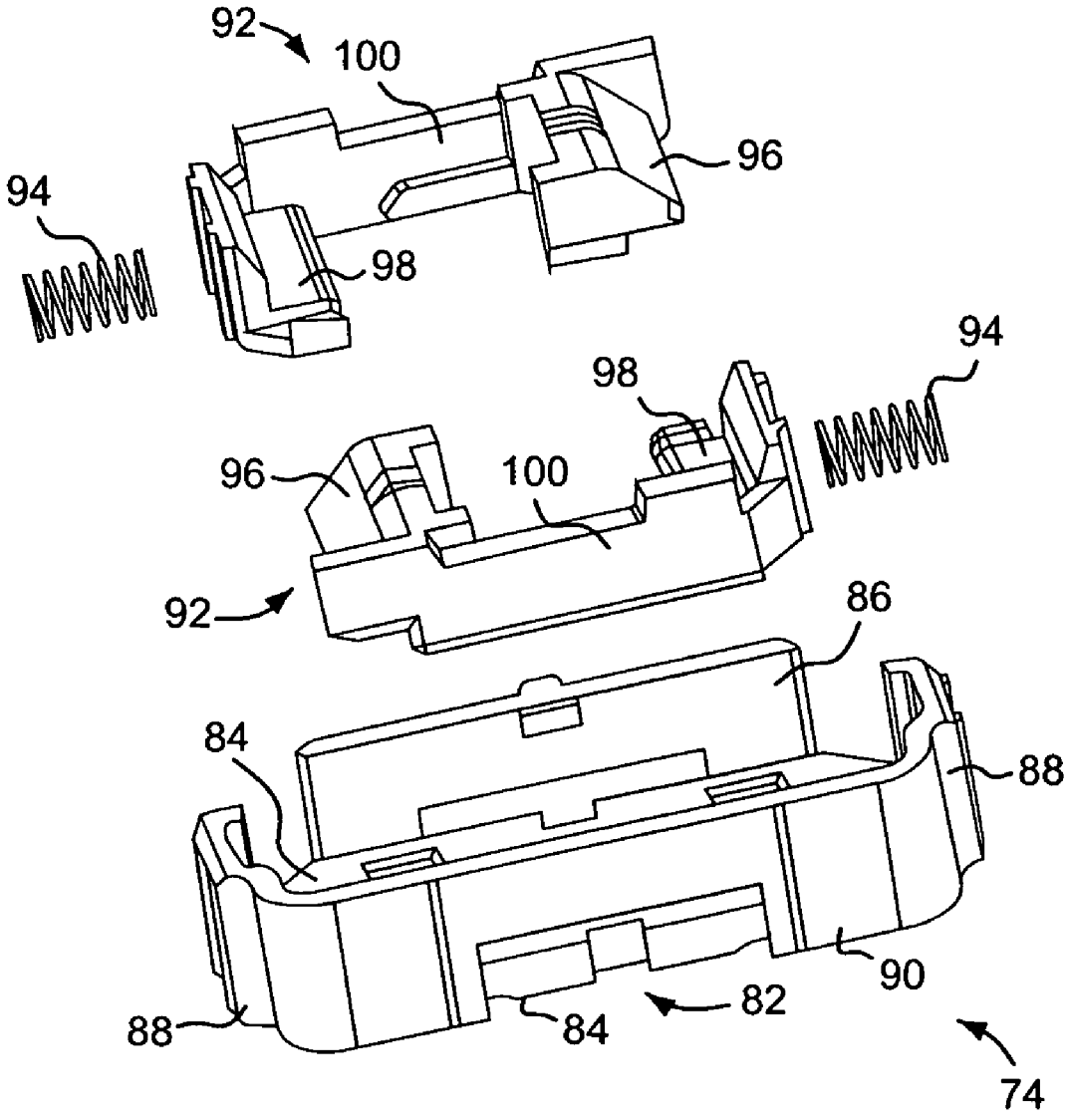
FIG. 20 is an exploded view of one of the tamper-resistant mechanisms shown in FIG. 19.
Figure 21:
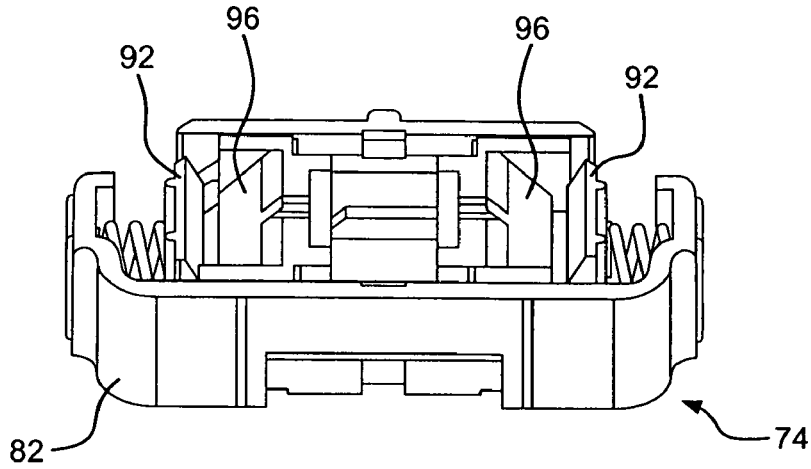
FIG. 21 is a perspective view of one of the tamper-resistant mechanisms shown in FIG. 19.
Figure 22:
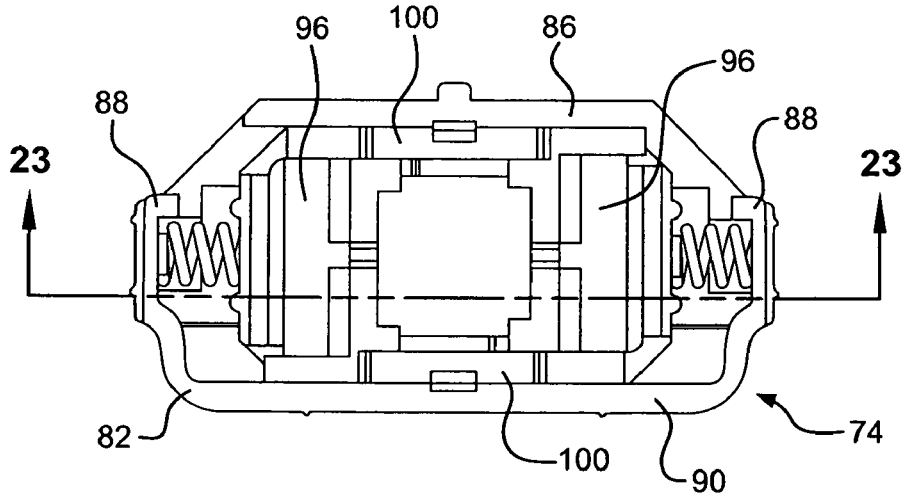
FIG. 22 is a top plan view of the tamper-resistant mechanism shown in FIG. 21.
Figure 23:
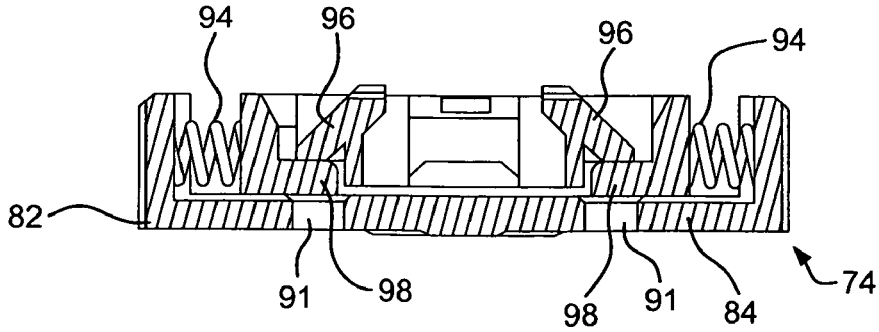
FIG. 23 is a cross-sectional view of the tamper-resistant mechanism taken along line 23-23 in FIG. 22.

Referring to FIG. 19, a tamper-resistant assembly 74 for each outlet is secured to the underside of front cover 2 between the phase blade and neutral blade face openings 4, 6 and the phase and neutral contacts 32, 36. Each tamper-resistant assembly 74 is snapped into place and held in a recess defined by two end walls 76, an inner wall 78 and an outer wall 80 that are integrally molded with front cover 2. The purpose of the tamper-resistant assemblies is to minimize the risk of electric shock by inhibiting or preventing access to the contacts 32, 36 by anything other than an electrical plug, i.e., allowing access only by the prongs of an electrical plug that are simultaneously inserted into the face openings 4, 6.

The structure of each tamper-resistant assembly 74 is depicted in FIGS. 20-23. A cradle 82 is defined by a generally trapezoidal bottom wall 84, a short side wall 86, end walls 88 and a long side wall 90 joined to end walls 88. Slots 91 in bottom wall 84 are aligned with face openings 4, 6 in front cover 2 and with contacts 32, 36 in base 12. Slidable within cradle 82 are two complementary shutters 92, each biased by a coil spring 94 captured at one end wall 88 toward the opposite end wall 88. Each shutter 92 has a cam surface 96 and a blocking step 98 interconnected by a side panel 100. In the at-rest positions shown in the figures, the cam surface 96 of each shutter is positioned in front of the blocking step 98 of the other shutter, which blocks an opening 91 in base 74. Concurrent insertion of two plug blades acts against the two cam surfaces 96 simultaneously to unblock both slots 91, allowing blade access to the contacts 32, 36. However, if only one shutter cam surface 96 is contacted by an inserted object, only that shutter will slide to move its blocking step away from the other slot 91, but that slot will remain blocked by the cam surface 96 of the other shutter.

Alternative outlet face opening arrangements according to the invention are depicted in FIGS. 25-31. The same reference characters used to denote the three face openings (4, 6, 8) and the centerlines (CL) of the first embodiment (FIG. 24) are used in connection with the other embodiments. Bus bars and contact separators for these alternative arrangements are not illustrated; however, those skilled in art can readily envision their configurations, which simply would have to accommodate the alternate locations of the face openings.

Figure 25:
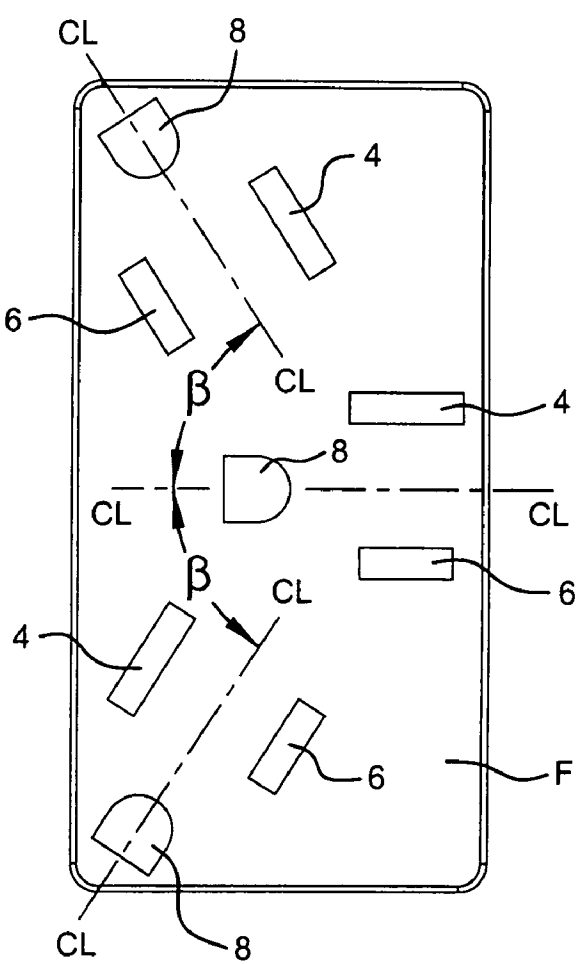
FIG. 25 is a schematic front view of an outlet face opening arrangement according to a second embodiment.

The arrangement of FIG. 25 is similar to that of the first embodiment, but the ground prong openings 8 of the corner outlets are slightly inboard of the corners, and are therefore laterally fully enclosed. Further, the centerlines of the corner outlets are angled more toward the center of the face, forming an angle $\beta$ of about 60° with the centerline of the center outlet, whose centerline bisects the face as in the first embodiment.

Figure 26:
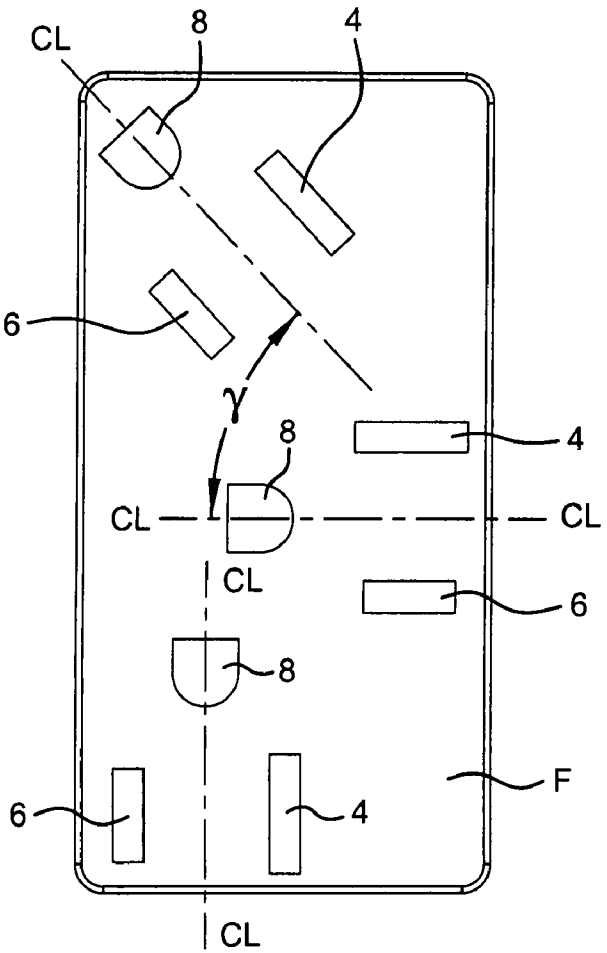
FIG. 26 is a schematic front view of an outlet face opening arrangement according to a third embodiment.

In the arrangement of FIG. 26, the centerline of the center outlet is parallel to the shorter edges of the face as in the first embodiment, but is displaced from the center of the face, away from the oblique upper corner outlet. That corner outlet has a laterally fully enclosed ground prong opening 8 slightly inboard of the corner, and a centerline that forms an angle $\gamma$ of about 45° with the centerline of the center outlet. The centerline of the other (lower) corner outlet is perpendicular to that of the center outlet, and its ground prong opening 8 is further from the adjacent short edge of the face than its phase and neutral blade openings 4, 6.

Figure 27:
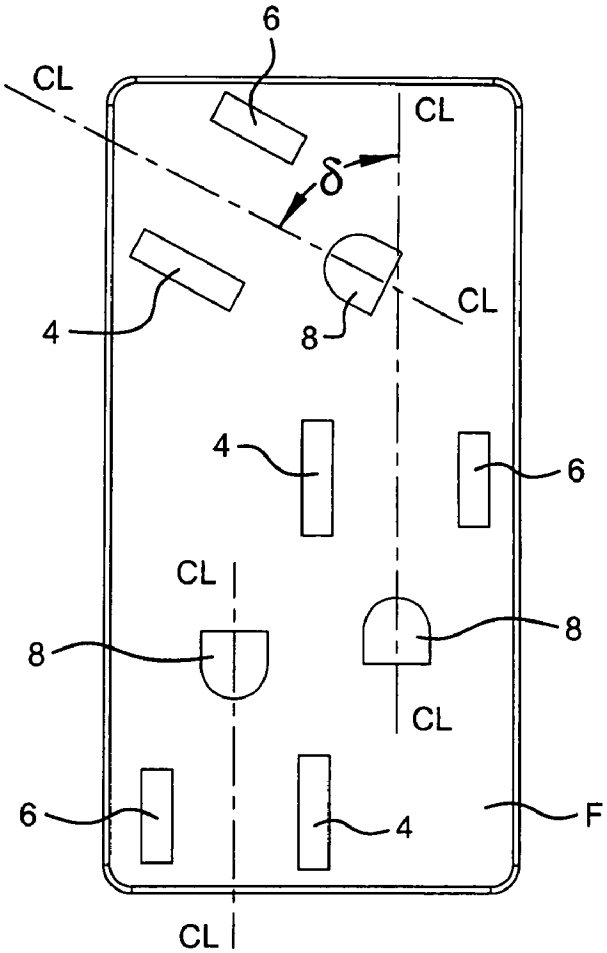
FIG. 27 is a schematic front view of an outlet face opening arrangement according to a fourth embodiment.

The arrangement of FIG. 27 is similar to that of FIG. 26, but the center outlet is turned 90° so that its centerline is parallel to the longer edges of the face, and parallel to that of the lower corner outlet. Also, the centerline of the upper corner outlet is angled further from the center of the face, forming an angle $\delta$ of about 65° with that of the center outlet.

Figure 28:
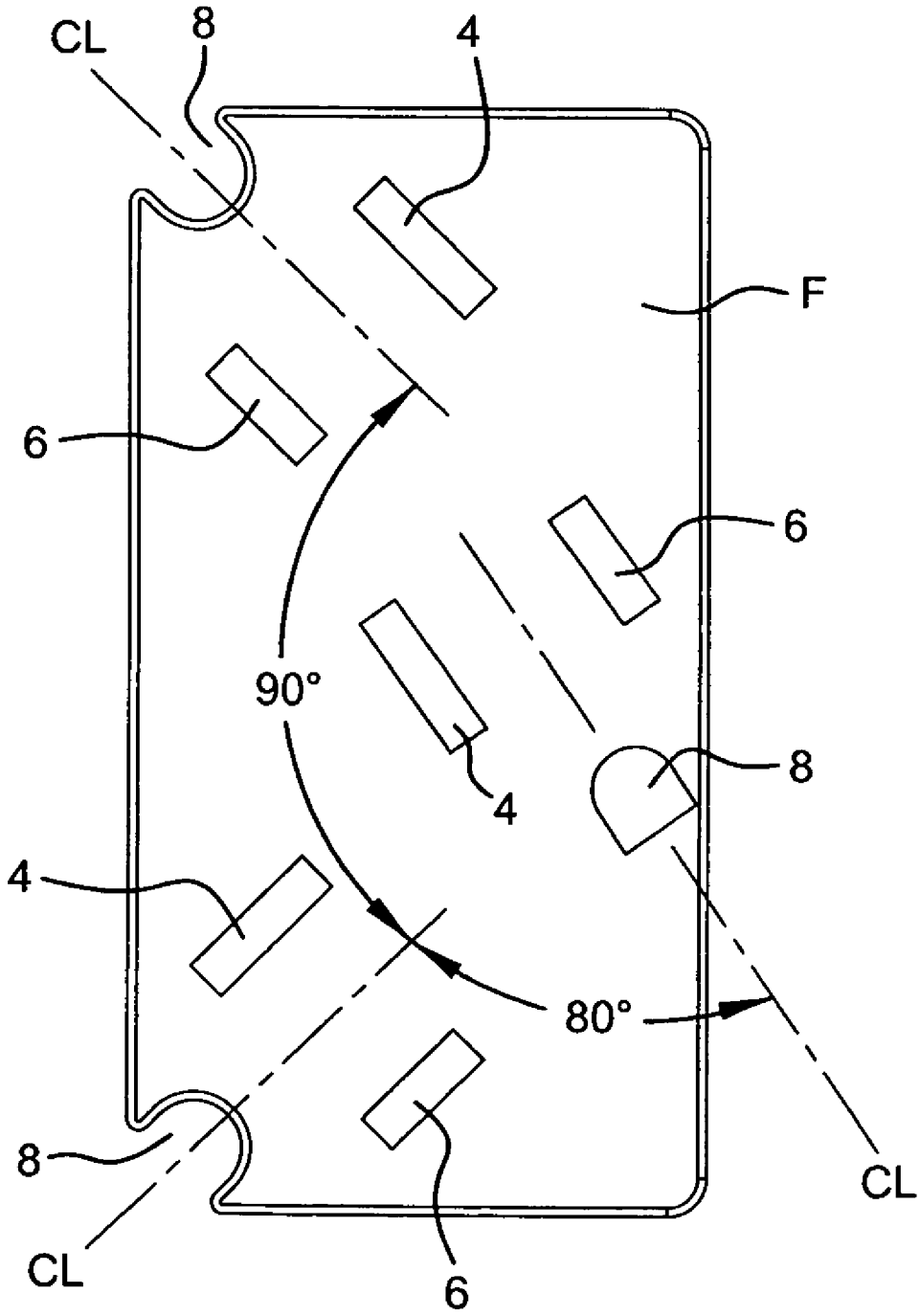
FIG. 28 is a schematic front view of an outlet face opening arrangement according to a fifth embodiment.

The arrangement of FIG. 28 is similar to that of the first embodiment (FIG. 24), but the center outlet is turned counterclockwise about 125° so that its centerline forms an angle of about 80° with that of the lower left outlet and an angle of about 10° with that of the upper left outlet, with its ground prong opening at the right edge of the face.

Figure 29:
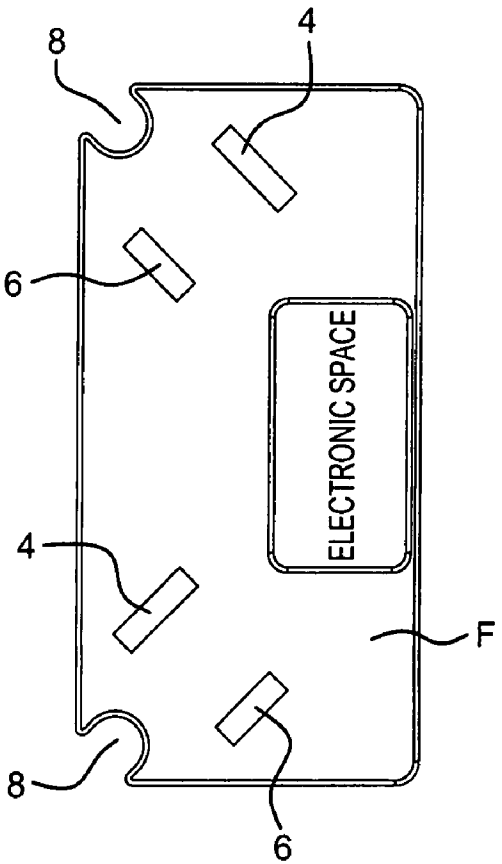
FIG. 29 is a schematic front view of an outlet face opening arrangement according to a sixth embodiment.

The embodiment of FIG. 29 is similar to the first embodiment, but it replaces the center outlet with an electronic space for housing an electrical device, which may have a user-accessible or visible interface on the face of the receptacle. Examples of such devices include, without limitation, a timer; a dimmer; a power monitoring device; a circuit breaker; a power indicator light; a signal port; an integral night light; an over-current protection device; a ground fault circuit interrupter (GFCI); and a transient voltage surge suppressor (TVSS).

Figure 30:
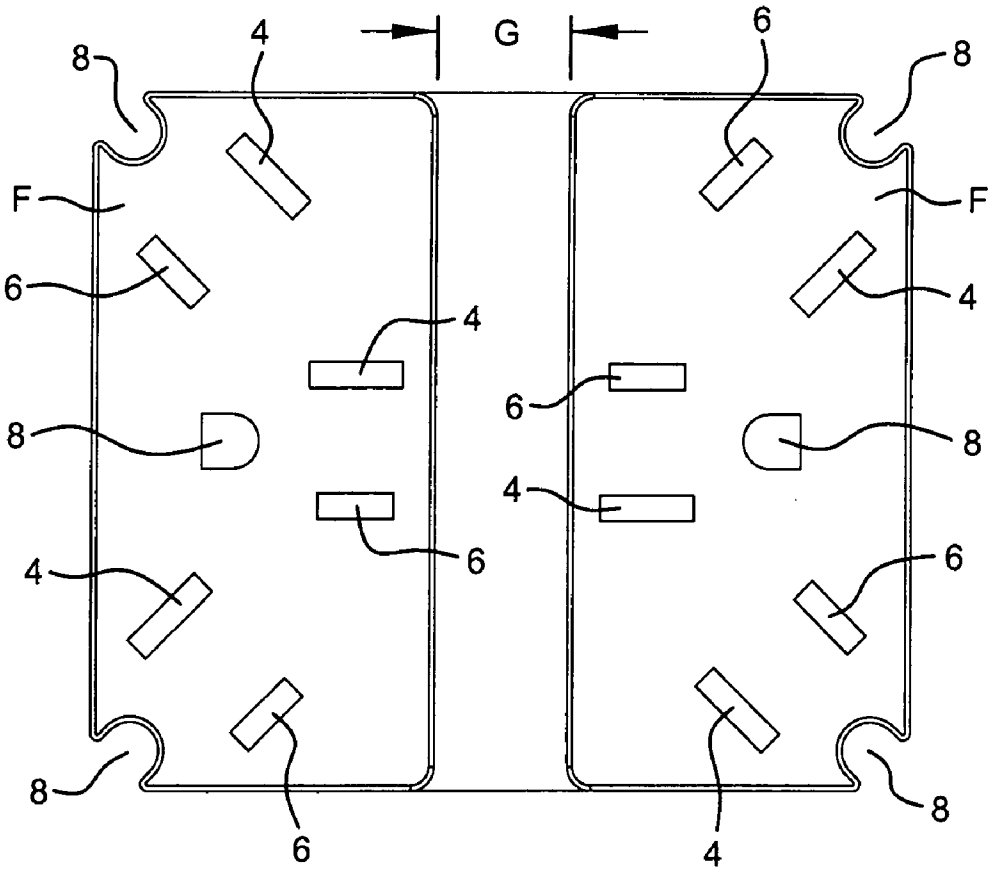
FIG. 30 is a schematic front view of an outlet face opening arrangement according to a seventh embodiment.

FIG. 30 depicts an arrangement providing six outlets housed in a receptacle body sized to fit in a NEMA-standard double wall box. Each face F is identical to that of the first embodiment in terms of its dimensions and its arrangement of openings 4, 6, 8. Preferably, there is a gap G of 0.502 in. between the faces so that the faces are 1.792 in. on center, and the overall width from the left edge of the left face to the right edge of the right face is 3.082 in. Single terminals on the body (not shown) are provided for attaching each of phase, neutral and ground line conductors. The phase and neutral bus bars and the ground straps associated with the two faces are interconnected by respective spot welded brass shunts or other welded conductors (not shown).

Figure 32:
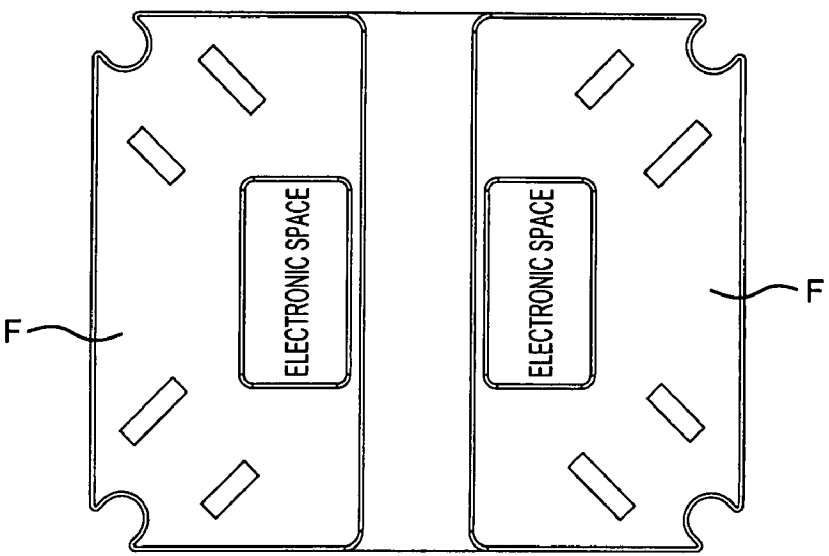
FIG. 32 is a schematic front view of an outlet face opening arrangement according to a ninth embodiment.
Figure 31:
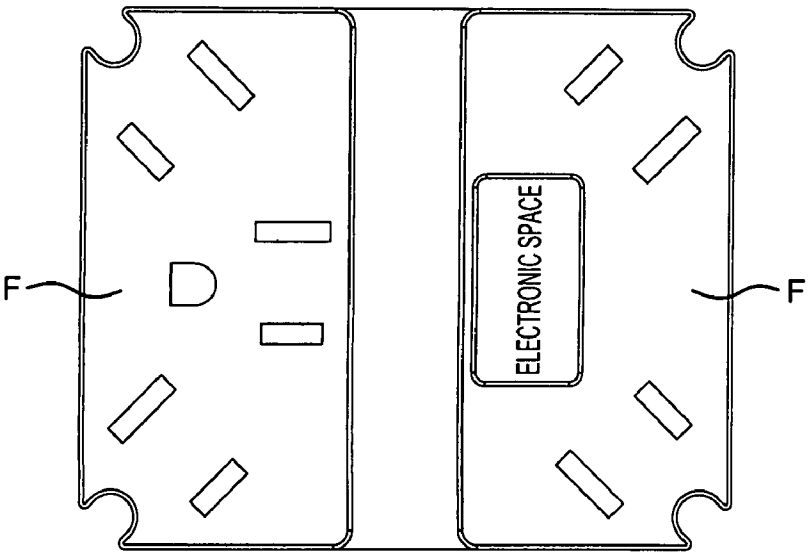
FIG. 31 is a schematic front view of an outlet face opening arrangement according to an eighth embodiment.

FIGS. 31 and 32 depict embodiments identical to that of FIG. 30, except that the electronic space feature of FIG. 29 is incorporated on one or both sides of the receptacle, respectively. In the embodiment of FIG. 31, the electronics spaces may house the same or different electrical devices.

While various embodiments have been chosen to illustrate the invention, it will be understood by those skilled in the art that various changes and modifications may be made without departing from the scope of the invention as defined by the appended claims. By way of example only, either face of a larger receptacle (sized to fit in a NEMA-standard double wall box) can be configured with any of the specifically disclosed single face arrangements (e.g., FIGS. 24-29), or with any other face arrangement within the scope of the claims. While the faces F of the various embodiments have been described as preferably being dimensioned to comply with the ANSI/NEMA WD 6 (R2008) dimensional standard for popular "decorator" style wiring devices, any of the specifically disclosed face arrangements, or any other face arrangement within the scope of the claims, can be used in receptacles having faces of other sizes.

What is claimed is:

1. An electrical receptacle comprising:

a body sized to fit in a NEMA-standard single wall box and having a substantially rectangular face defined by two shorter edges about 1.30 in. long and two longer edges about 2.62 in. long, and phase, neutral and ground contacts within the body associated with respective first, second and third outlets and accessible by the phase blades, neutral blades and ground prongs of plugs or electrical devices via respective phase blade openings, neutral blade openings and ground prong openings in the face, wherein the ground prong openings of the first and second outlets are located at opposite ends of a common longer edge of the face, and the ground prong opening of the third outlet is located centrally of the face.

2. The electrical receptacle of claim 1, wherein the ground prong openings of the first and second outlets are laterally open.

3. The electrical receptacle of claim 2, wherein the body has a laterally open groove aligned with the ground prong opening of each of the first and second outlets.

4. The electrical receptacle of claim 3, wherein the laterally open grooves are at corners of the body.

5. The electrical receptacle of claim 1, wherein the ground prong opening of the third outlet is closer to the common longer edge of the face than the phase and neutral blade openings of the third outlet.

6. The electrical receptacle of claim 5, wherein the phase and neutral blade openings of the third outlet are parallel to the shorter edges of the face.

7. The electrical receptacle of claim 2, wherein the ground prong opening of the third outlet is at the longer edge of the face opposite said common longer edge, and the phase and neutral blade openings of the third outlet are oblique to the edges of the face.

8. An electrical receptacle comprising:

a body sized to fit in a NEMA-standard single wall box and having a substantially rectangular face defined by two shorter edges about 1.30 in. long and two longer edges about 2.62 in. long, and phase, neutral and ground contacts within the body associated with respective first, second and third outlets and accessible by the phase blades, neutral blades and ground prongs of plugs or electrical devices via respective phase blade openings, neutral blade openings and ground prong openings in the face, each outlet having a centerline that passes through its ground prong opening and is parallel to its phase and neutral blade openings, wherein the centerlines of the first and second outlets are oblique to the edges of the face, wherein the ground prong openings of the first and second outlets are further from the center of the face than their phase and neutral blade openings, and wherein the openings of the third outlet are located between the openings of the first and second outlets.

9. The electrical receptacle of claim 8, wherein the centerline of the third outlet is parallel to the shorter edges of the face.

10. The electrical receptacle of claim 9, wherein the centerline of the third outlet bisects the face.

11. The electrical receptacle of claim 8, wherein the centerlines of the first and second outlets are nonparallel.

12. The electrical receptacle of claim 11, wherein the centerlines of the first and second outlets are mutually oblique.

13. The electrical receptacle of claim 8, wherein the ground prong openings of the first and second outlets are located at corners of the face.

14. The electrical receptacle of claim 13, wherein the ground prong openings of the first and second outlets are located at corners of the face that share a common longer edge of the face.

15. The electrical receptacle of claim 14, wherein the ground prong opening of the third outlet is at the longer edge of the face opposite said common longer edge, and the centerline of the third outlet is oblique to the edges of the face and oblique to the centerlines of the first and second outlets.

16. An electrical receptacle comprising:

a body sized to fit in a NEMA-standard single wall box and having a substantially rectangular face defined by two shorter edges and two longer edges, and phase, neutral and ground contacts within the body associated with respective first, second and third outlets and accessible by the phase blades, neutral blades and ground prongs of plugs or electrical devices via respective phase blade openings, neutral blade openings and ground prong openings in the face, each outlet having a centerline that passes through its ground prong opening and is parallel to its phase and neutral blade openings, wherein the centerline of the first outlet is oblique to the edges of the face and oblique to the centerline of at least one other outlet.

17. The electrical receptacle of claim 16, wherein the centerlines of all of the outlets are mutually nonparallel.

18. The electrical receptacle of claim 17, wherein the centerlines of all of the outlets are mutually oblique.

19. The electrical receptacle of claim 16, wherein the centerline of the second outlet is parallel to an edge of the face.

20. The electrical receptacle of claim 19, wherein the centerline of the third outlet is perpendicular to the centerline of the second outlet.

21. The electrical receptacle of claim 19, wherein the centerline of the third outlet is parallel to the centerline of the second outlet.

22. The electrical receptacle of claim 16, wherein the ground prong opening of the first outlet is further from the center of the face than its phase and neutral blade openings.

23. The electrical receptacle of claim 22, wherein the ground prong opening of the first outlet is located at a corner of the face.

24. The electrical receptacle of claim 23, wherein the centerline of the second outlet is oblique to the edges of the face, and the ground prong opening of the second outlet is located at a corner of the face.

25. The electrical receptacle of claim 24, wherein the ground prong openings of the first and second outlets are laterally open.

26. The electrical receptacle of claim 25, wherein the ground prong opening of the third outlet is at a longer edge of the face, and the centerline of the third outlet is oblique to the edges of the face and oblique to the centerlines of the first and second outlets.

27. The electrical receptacle of claim 25, wherein the body has a laterally open groove aligned with the ground prong opening of each of the first and second outlets.

28. The electrical receptacle of claim 27, wherein the laterally open grooves are at corners of the body.

29. The electrical receptacle of claim 22, wherein the ground prong opening of the second outlet is closer to the center of the face than its phase and neutral blade openings.

30. The electrical receptacle of claim 29, wherein the ground prong opening of the third outlet is closer to the center of the face than its phase and neutral blade openings.

31. The electrical receptacle of claim 16, wherein the ground prong openings of the first and second outlets are closer to the center of the face than their phase and neutral blade openings.

32. An electrical receptacle comprising:

a body sized to fit in a NEMA-standard single wall box and having a substantially rectangular face defined by two shorter edges about 1.30 in. long and two longer edges about 2.62 in. long;

phase, neutral and ground contacts within the body associated with respective first and second outlets and accessible by the phase blades, neutral blades and ground prongs of plugs or electrical devices via respective phase blade openings, neutral blade openings and ground prong openings in the face, each outlet having a centerline that passes through its ground prong opening and is parallel to its phase and neutral blade openings; and an electrical device in the body having a user-accessible or visible interface on the face of the receptacle between the openings of the first and second outlets, wherein the centerlines of the first and second outlets are oblique to the edges of the face and are nonparallel.

33. The electrical receptacle of claim 32, wherein the ground prong openings of the first and second outlets are further from the center of the face than their phase and neutral blade openings.

34. The electrical receptacle of claim 33, wherein the ground prong openings of the first and second outlets are located at corners of the face.

35. The electrical receptacle of claim 34, wherein the ground prong openings of the first and second outlets are located at corners of the face that share a common longer edge of the face.

36. The electrical receptacle of claim 33, wherein the ground prong openings of the first and second outlets are laterally open.

37. The electrical receptacle of claim 36, wherein the body has a laterally open groove aligned with the ground prong opening of each of the first and second outlets.

38. The electrical receptacle of claim 37, wherein the laterally open grooves are at corners of the body.

39. The electrical receptacle of claim 32, wherein the electrical device is selected from the group consisting of a timer, a dimmer, a power monitoring device, a circuit breaker, a power indicator light, a signal port, an integral night light, an over-current protection device, a ground fault circuit interrupter, and a transient voltage surge suppressor.

40. An electrical receptacle comprising:

a body sized to fit in a NEMA-standard double wall box and having a side-by-side pair of spaced substantially rectangular faces, each face defined by two shorter edges about 1.30 in. long and two longer edges about 2.62 in. long, and phase, neutral and ground contacts within the body associated with respective first, second and third outlets of each face and accessible by the phase blades, neutral blades and ground prongs of plugs or electrical devices via respective phase blade openings, neutral blade openings and ground prong openings in the faces, wherein the ground prong openings of the first and second outlets of each face are located at opposite ends of the longer laterally outer edge of the face, and the ground prong opening of the third outlet is located centrally of the face.

41. The electrical receptacle of claim 40, wherein the ground prong openings of the first and second outlets of each face are laterally open.

42. The electrical receptacle of claim 41, wherein the body has a laterally open groove aligned with the ground prong opening of each of the first and second outlets of each face.

43. The electrical receptacle of claim 42, wherein the laterally open grooves are at corners of the body.

44. The electrical receptacle of claim 40, wherein the ground prong opening of the third outlet of each face is closer to the common longer laterally outer edge of the face than the phase and neutral blade openings of the third outlet.

45. The electrical receptacle of claim 44, wherein the phase and neutral blade openings of the third outlet of each face are parallel to the shorter edges of the face.

46. The electrical receptacle of claim 41, wherein the ground prong opening of the third outlet of each face is at the longer laterally inner edge of the face, and the phase and neutral blade openings of the third outlet of each face are oblique to the edges of the face.

47. An electrical receptacle comprising:

a body sized to fit in a NEMA-standard double wall box and having a side-by-side pair of spaced substantially rectangular faces, each face defined by two shorter edges and two longer edges;

phase, neutral and ground contacts within the body associated with respective first and second outlets of each face and accessible by the phase blades, neutral blades and ground prongs of plugs or electrical devices via respective phase blade openings, neutral blade openings and ground prong openings in the faces, each outlet having a centerline that passes through its ground prong opening and is parallel to its phase and neutral blade openings; and two electrical devices in the body, each associated with a respective face of the receptacle and having a user-accessible or visible interface on the respective face of the receptacle between the openings of the first and second outlets, wherein the centerlines of the first and second outlets of each face are oblique to the edges of the face and are nonparallel.

48. The electrical receptacle of claim 47, wherein the ground prong openings of the first and second outlets of each face are further from the center of the face than their phase and neutral blade openings.

49. The electrical receptacle of claim 48, wherein the ground prong openings of the first and second outlets of each face are located at corners of the face.

50. The electrical receptacle of claim 49, wherein the ground prong openings of the first and second outlets of each face are located at corners of the face at the opposite ends of the longer laterally outer edge of the face.

51. The electrical receptacle of claim 47, wherein the electrical device associated with either face is selected from the group consisting of a third outlet, a timer, a dimmer, a power monitoring device, a circuit breaker, a power indicator light, a signal port, an integral night light, an over-current protection device, a ground fault circuit interrupter, and a transient voltage surge suppressor.

52. The electrical receptacle of claim 51, wherein the electrical device associated with at least one of the faces is an outlet comprising phase, neutral and ground contacts within the body and respective phase blade, neutral blade and ground prong openings in the face associated therewith.

* * * * *